US006846166B2

(12) United States Patent
Kinugawa

(10) Patent No.: US 6,846,166 B2
(45) Date of Patent: Jan. 25, 2005

(54) RECIPROCATING DIAPHRAGM PUMP WITH DEGASSING VALVES

(75) Inventor: Shigehisa Kinugawa, Asago-gun (JP)

(73) Assignee: Tacmina Corporation, Hyogo (JP)

( * ) Notice: Subject to any disclaimer, the term of this patent is extended or adjusted under 35 U.S.C. 154(b) by 9 days.

(21) Appl. No.: 10/278,271

(22) Filed: Oct. 22, 2002

(65) Prior Publication Data

US 2003/0077190 A1 Apr. 24, 2003

(30) Foreign Application Priority Data

Oct. 24, 2001 (JP) ..... 2001-326777
Oct. 9, 2002 (JP) ..... 2002-296638

(51) Int. Cl.[7] ..... F04B 43/06; F04B 17/00; F04B 35/02; F04B 39/00; F04B 23/00

(52) U.S. Cl. ..... 417/395; 417/390; 417/379; 417/385; 417/389; 417/435; 417/439; 417/440

(58) Field of Search ..... 417/390, 379, 417/385, 389, 395, 435, 439, 440; 60/592

(56) References Cited

U.S. PATENT DOCUMENTS 2,732,807 A * 1/1956 Parsegian ..... 417/326
3,762,838 A * 10/1973 Sato ..... 417/395
4,619,589 A 10/1986 Muller et al.
5,246,351 A * 9/1993 Horn et al. ..... 417/387
5,810,567 A * 9/1998 Horn ..... 417/387

FOREIGN PATENT DOCUMENTS

JP 61-61990 3/1986
JP 2000-356274 12/2000

* cited by examiner

*Primary Examiner*—Justine R. Yu
*Assistant Examiner*—Timothy P. Solak
(74) *Attorney, Agent, or Firm*—Fulbright & Jaworski L.L.P.

(57) ABSTRACT

In a reciprocating pump, drive power of a drive-power supply member is transmitted to a diaphragm within a diaphragm drive chamber via operating fluid. An operating-fluid-flow regulation chamber for regulating the flow of operating fluid is located between the drive-power supply member and the diaphragm drive chamber. A first gas discharge member and a second gas discharge member are respectively located in an upper part of the inside of the operating-fluid-flow regulation chamber and an upper part of the inside of the diaphragm drive chamber. The first gas discharge member is held in fluid communication with the second gas discharge member so as to constitute a single gas discharge mechanism. This single gas discharge mechanism is provided with a reverse-flow prevention member for preventing a reverse flow of fluid from the first gas discharge member to the second gas discharge member.

7 Claims, 17 Drawing Sheets

RECIPROCATING DIAPHRAGM PUMP WITH DEGASSING VALVES

BACKGROUND OF THE INVENTION

1. Field of the Invention

The present invention relates to a reciprocating pump and a check valve, and more particularly to a reciprocating pump that is capable of discharging gas therefrom and a check valve used for the reciprocating pump.

2. Related Art

A reciprocating pump for delivering fluid by driving a diaphragm has been hitherto known, which is generally designed to convert rotational motion produced by a driving means such as a motor into linear motion via a cam so as to drive the diaphragm by this linear reciprocating motion. A more specific construction hitherto known is that linear reciprocating motion based upon a motor or the like is transmitted to the diaphragm via operating fluid as an operating medium.

The thus constructed reciprocating pump is so operated that an elastically deformable diaphragm is reciprocated by using operating fluid, which reciprocating motion causes suction and discharge of fluid to be delivered (target fluid). In order to achieve the required degree of elastic deformability and reciprocating motion, the diaphragm is formed with a thinner wall.

The above conventional reciprocating pump, which is constructed by using such a thin diaphragm, may cause undesirable deformation or cracks of the diaphragm, or any other damage thereto due to excessive load applied to the diaphragm.

A known reciprocating pump, which employs a technique to prevent such a deformation or clack of the diaphragm, is disclosed in for example Japanese Patent Application Laid-open No. Sho-61-61990 (Reference 1). The disclosed reciprocating pump is provided with a valve unit which is operated along with the diaphragm so that the valve unit limits the motion of the diaphragm and hence controls inflow of operating fluid before excessive load is applied to the diaphragm.

In a fluid delivery passage according to a prior art arrangement, a check valve, which is made up by using a ball or the like, is provided so as to prevent reverse flaw of the target fluid. Particularly, for delivering high viscous fluid (sticky fluid), a know construction as disclosed in for example Japanese Patent Application Laid-open No. 2000-356274 (Reference 2) employs an urging member such as a spring for moving the ball so as to securely close a fluid passage. That is, when delivering high viscous fluid, frictional resistance is caused on the ball serving as a valve element, which in turn causes delay in seating the ball, during which delay fluid reversely flows in the passage. As a result, the discharge rate of the pump is decreased, thus affecting on the performance of the pump to constantly deliver fluid. Therefore, as described above, the urging member such as a spring is provided on an upper portion of the ball so as to enhance smooth seating of the ball in the conventional arrangement.

However, the conventional reciprocating pump as disclosed in the Reference 1 requires a relief valve (escape valve) for controlling a flow of operating fluid and a degassing member (discharge valve) for removing gas such as air mixed into or generated in operating fluid, and therefore has a problem of causing troublesome work particularly in degassing operation by using this degassin member.

Since the above conventional reciprocating pump is so designed to make the diaphragm reciprocate by means of operating fluid, gas such as air may be mixed into operating fluid during assembling or driving the pump. It is desirable to avoid such mixing of gas into operating fluid in the reciprocating pump having an arrangement with the diaphragm reciprocated by operating fluid. For the purpose of avoiding this, the conventional pump employs a degassing mechanism (a degassing member) provided between the diaphragm and the valve unit so as to properly remove gas in an initial operation subsequent to assembling of the pump and at the time when gas intrudes during the drive of the pump.

The degassing operation by using the above mechanism involves removing a lid member such as a bolt disposed on the degassing member and bringing a suction device or the like into communication with this degassing member. During this degassing operation, operating fluid may overflow from the degassing member along with gas, and therefore an oil pan or the like must be disposed around the degassing member.

Also, gas, which has been mixed into along with operating fluid, may be removed from the relief valve provided near the valve unit. However, in the prior art technique as disclosed in the Reference 1, the construction of the relief valve cannot be ascertained from the disclosure of this Reference so that the relationship between adjustment of operating fluid and degassing cannot be clearly understood.

That is, according to the prior art technique, of the degassing member for gas removal and the relief valve for resultingly achieve degassing, the former involves a troublesome work in gas removing operation, and the latter is of an unknown construction not designed for positive degassing operation, and therefore poses a problem that its effect cannot be clearly expected.

Also, in the check valve according to the prior art technique as disclosed in the Reference 2, the movement of the ball as a valve element is enhanced by the urging member such as a spring so as to securely close the flow passage. This arrangement causes increased resisting force between the valve element and a valve seat and hence cavitation during a suction step, which may deteriorate the pumping performance. Also, when a spring or the like exerting a strong spring force is used, it is necessary to prime fluid into the pump before actuating the pump due to lack of self-feeding of fluid. As another problem, the pressing force, which presses the ball against the valve seat by the spring or the like for closing the flow passage, may cause local or uneven wear-out of the ball, valve seat or the like.

In case of using the reciprocating pump according to the prior art technique for delivering high viscous fluid (sticky fluid), it also causes a problem that fluid cannot be delivered at a constant rate in a proper manner even if the check valve or the like is employed. Specifically, if fluid has high viscosity, fluid is hard to flow, with the result that it cannot be properly sucked by driving the diaphragm or any other reciprocating means, only. Thus, fluid delivery at a constant rate is hardly achieved.

Therefore, it is an object of the present invention to provide a reciprocating pump equipped with a gas discharge mechanism that is capable of properly and automatically discharging gas without a troublesome work involved.

It is another object of the present invention to provide a valve seat that is capable of securely closing a fluid passage, while reducing local or uneven wear-out of a ball or the valve seat itself without the necessity to prime fluid.

It is still another object of the present invention to provide a reciprocating pump that is capable of delivering fluid at a constant rate even if fluid has high viscosity.

SUMMARY OF THE INVENTION

According to the present invention, there is provided a reciprocating pump for delivering fluid, which includes: a diaphragm that is reciprocated so as to deliver fluid; a diaphragm drive chamber provided therein with the diaphragm; and a drive-power supply member for supplying drive power for reciprocating the diaphragm, in which drive power of the drive-power supply member is transmitted to the diaphragm within the diaphragm drive chamber via operating fluid, and an operating-fluid-flow regulation chamber for regulating the flow of operating fluid is located between the drive-power supply member and the diaphragm drive chamber. A first gas discharge member and a second gas discharge member are respectively located in an upper part of the inside of the operating-fluid-flow regulation chamber and an upper part of the inside of the diaphragm drive chamber. The first gas discharge member is held in fluid communication with the second gas discharge member so as to constitute a single gas discharge mechanism. The single gas discharge mechanism is provided with a reverse-flow prevention member for preventing a reverse flow of fluid from the first gas discharge member to the second gas discharge member.

With the reciprocating pump having the above arrangement, which constitutes the single gas discharge mechanism by a plurality of gas discharge members (the first and second gas discharge members) that are held in fluid communication with each other, gas discharged from the plurality of gas discharge members can be properly discharged only by adjusting the single gas discharge mechanism.

Preferably, the operating-fluid-flow regulation chamber is provided with a valve element that is provided adjacent to the diaphragm to be driven along with the diaphragm, and a valve seat that is brought into engagement with the valve element so as to regulate operating fluid supplied into the diaphragm drive chamber. The first gas discharge member has a first end located between the drive-power supply member and the valve seat within the operating-fluid-flow regulation chamber, and the second gas discharge member has a first end located between the valve seat and the diaphragm within the diaphragm drive chamber.

With the above arrangement, an excessive load applied to the diaphragm can be properly limited by using such as the valve element. Also, since the first gas discharge member and the second gas discharge member are provided on the upstream and downstream sides of the valve element and the valve seat (i.e., the diaphragm drive chamber and the operating-fluid-flow regulation chamber), gas around the diaphragm can be properly discharged therethrough.

Preferably, the first gas discharge member and the second gas discharge member respectively have second ends, which are located closer to each other; and the reverse-flow prevention member is provided above the second end of the second gas discharge member so that when fluid is discharged from the first gas discharge member, the reverse-flow prevention member is pressed against the second end of the second gas discharge member upon receiving the pressure of the fluid so as to close the second end of the second gas discharge member, and when fluid is discharged from the second gas discharge member, the reverse-flow prevention member is lifted up from the second end of the second gas discharge member so as to open the second end of the second gas discharge member.

With the above arrangement, gas and operating fluid, which may reversely flow due to the arrangement with the two gas discharge members fluidly communicated with each other, can be prevented from flowing to the diaphragm drive chamber, and hence allow the reciprocating pump to be properly driven.

Preferably, the single gas discharge mechanism is made up by using the first gas discharge member, the second gas discharge member, the reverse-flow prevention member and a fluid-discharge-adjusting member; and the fluid-discharge-adjusting member is made up by using a ball member provided above the reverse-flow prevention member, and an adjustment valve for adjusting a lift amount of the ball member.

With the above arrangement, it is possible to properly discharge gas by means of the adjustment valve when needed.

Preferably, the lift amount of the reverse-flow prevention member and the lift amount of the ball member are set at given amounts so that gas is automatically discharged from the first gas discharge member and the second gas discharge member.

In the above arrangement, the lift amount of the reverse-flow prevention member is preferably set at about 0.5 mm–2.0 mm and more preferably 1.0 mm–1.5 mm, and the lift amount of the ball member is preferably set at about 0.5 mm–2.0 mm and more preferably 0.5 mm–1.0 mm.

The reverse-flow prevention member is preferably a ball member that is made of a material having a specific gravity being approximate to a specific gravity of operating fluid. As a material having a specific gravity being approximate to a specific gravity of operating fluid, polypropylene can be cited.

Preferably, an operating-fluid replenishing means is provided so as to replenish the amount of operating fluid discharged from at least one of the first gas discharge member and the second gas discharge member.

As the operating-fluid replenishing mechanism, there can be cited an auxiliary plunger mechanism for supplying the amount of operating fluid discharged along with gas during the gas discharging operation prepared based upon expectation of such gas discharge, and an operating-fluid replenishing valve (an operating-fluid replenishing valve with its replenishing pressure variable) for supplying operating fluid according to the variation of the pressure within the diaphragm drive chamber.

With the above arrangement equipped with the operating-fluid replenishing mechanism (the auxiliary plunger mechanism, the operating-fluid replenishing valve, or the like), it is possible to replenish the amount of operating fluid expected to be discharged along with gas during the gas discharging operation, or replenish operating fluid when an excessive negative pressure is caused in the diaphragm drive chamber. As a result, the reciprocating pump can be operated in a stabilized manner without deterioration of the pump efficiency.

According to another aspect of the present invention, there is provided a check valve, which includes: a valve body having a fluid communication passage; a valve element provided within the valve body so as to open and close the fluid communication passage; and an urging member provided within the valve body so as to apply urging force to the valve element. The urging member is provided so as to urge the valve element towards an inlet side through which fluid flows; and a given clearance is created between the valve element and the urging member when the fluid communication passage has been closed by the valve element.

With the check valve having the above arrangement, the valve element is urged towards the inlet side through which fluid flows, so that the fluid communication passage of the valve body can be more securely and hermetically closed by the valve element. Also, there is created the given clearance between the urging member and the valve element when the fluid communication passage has been closed by the valve element. As a result, the valve element is not forcibly pressed against the valve seat and therefore wear-out of the valve element, the valve seat and the like can be effectively reduced.

According to still another object of the present invention, there is provided a check valve, which includes: a valve body having a fluid communication passage; a valve element provided within the valve body so as to open and close the fluid communication passage; and electromagnet means provided at least in or around the valve body. The valve element is made of a magnetic material; and at least one of a timing at which electricity is sent to the electromagnet means and a timing at which the polarity of electricity sent to the electromagnet means is determined according to a timing at which the fluid communication passage is opened and closed by the valve element. When the electromagnet means is provided in the valve body in the above arrangement, it is not provided in the fluid communication passage but in a wall part defining the fluid communication passage. Also, as an alternative to separately providing the electromagnet means, the valve body itself may serve as an electromagnet means.

With the above arrangement, the valve element is moved by means of the electromagnetic means so that the valve element can be properly moved by adjusting the timing at which electricity is sent to the electromagnetic means. That is, it is possible to provide the check valve that exhibits a high response capability in operation. As a result, the fluid communication passage can be opened and closed at a proper timing even if fluid has a high viscosity.

Also, with the above arrangement, the fluid communication passage can be opened by lifting up the valve element, which can be moved by means of the electromagnetic means. Therefore, a cleaning fluid remained in the line after cleaning, or a target fluid in the line can be easily discharged and recovered when needed by lifting up the valve element and hence opening the fluid communication passage.

Preferably, a capacitor is provided in an electric power supply line to the electromagnet means. With this arrangement, it is possible to send a large volume of electricity to the electromagnetic means in a moment, allowing the electromagnetic means to generate a large electromagnetic force. As a result, it is possible to provide the check valve that exhibits a high response capability in closing operation.

According to still another aspect of the present invention, there is provided a reciprocating pump for delivering fluid, which includes: a first diaphragm and a second diaphragm that are reciprocated to deliver fluid; diaphragm drive chambers respectively provided therein with the first and second diaphragms; and a drive-power supply member for supplying drive power for reciprocating the first and second diaphragms. The drive-power supply member includes a single eccentric cam, and a first piston member and a second piston member that are reciprocated by the rotation of the single eccentric cam. Drive powers of the first and second piston members are respectively transmitted to the first and second diaphragms via operating fluid; and an auxiliary drive member is provided so as to deliver fluid into fluid delivery sections respectively provided within the diaphragm drive chambers.

Preferably, the auxiliary drive member includes a first auxiliary diaphragm and a second auxiliary diaphragm that are reciprocated so as to deliver fluid; and an auxiliary eccentric cam for reciprocating the first and second auxiliary diaphragms. The auxiliary eccentric cam is rotated by means of a drive-power transmission shaft for driving the single eccentric cam. The auxiliary eccentric cam may be rotated by means of the drive-power transmission shaft in synchronization therewith.

According to yet another aspect of the present invention, there is provided a reciprocating pump for delivering fluid, which includes: a diaphragm that is reciprocated to deliver fluid; a diaphragm drive chamber provided therein with the diaphragm; a drive-power supply member for supplying drive power for reciprocating the diaphragm; and check valves respectively provided on the upstream side and downstream side of the diaphragm. Each of the check valves includes a valve body having a fluid communication passage, a valve element provided within the valve body so as to open and close the fluid communication passage and an urging member provided within the valve body so as to apply urging force to the valve element, in which the urging member is provided so as to urge the valve element towards an inlet side through which fluid flows, and a given clearance is created between the valve element and the urging member when the fluid communication passage has been closed by the valve element.

According to another aspect of the present invention, there is provided a reciprocating pump for delivering fluid, which includes: a first diaphragm and a second diaphragm that are reciprocated to deliver fluid; diaphragm drive chambers respectively provided therein with the first and second diaphragms; and a drive-power supply member for supplying drive power for reciprocating the first and second diaphragms. The drive-power supply member includes a single eccentric cam, and a first piston member and a second piston member that are reciprocated by the rotation of the single eccentric cam. In this arrangement, drive powers of the first and second piston members are respectively transmitted to the first and second diaphragms via operating fluid. An auxiliary drive member is provided so as to deliver fluid into fluid delivery sections respectively provided within the diaphragm drive chambers. The auxiliary drive member includes a first auxiliary diaphragm and a second auxiliary diaphragm that are reciprocated so as to deliver fluid, and an auxiliary eccentric cam for reciprocating the first and second auxiliary diaphragms. The auxiliary eccentric cam is rotated by means of a drive-power transmission shaft for driving the single eccentric cam. In this regard, the auxiliary eccentric cam may be rotated by means of the drive-power transmission shaft in synchronization with the drive-power transmission shaft. Check valves are respectively provided on the upstream side and downstream side of each of the first and second diaphragms. Each of the check valves includes a valve body having a fluid communication passage, a valve element provided within the valve body so as to open and close the fluid communication passage and an urging member provided within the valve body so as to apply urging force to the valve element, in which the urging member is provided so as to urge the valve element towards an inlet side through which fluid flows, and a given clearance is created between the valve element and the urging member when the fluid communication passage has been closed by the valve element.

According to still another aspect of the present invention, there is provided a reciprocating pump for delivering fluid, which includes: a diaphragm that is reciprocated to deliver fluid; a diaphragm drive chamber provided therein with the diaphragm; a drive-power supply member for supplying drive power for reciprocating the diaphragm; and check valves respectively provided on the upstream side and downstream side of the diaphragm. Each of the check valves includes a valve body having a fluid communication passage and a valve element provided within the valve body so as to open and close the fluid communication passage, in which electromagnet means is provided at least in or around the valve body, the valve element is made of a magnetic material, and at least one of a timing at which electricity is sent to the electromagnet means and a timing at which the polarity of electricity sent to the electromagnet means is determined according to a timing at which the fluid communication passage is opened and closed by the valve element. When the electromagnet means is provided in the valve body in the above arrangement, it is not provided in the fluid communication passage but in a wall part defining the fluid communication passage. Also, as an alternative to separately providing the electromagnet means, the valve body itself may serve as an electromagnet means.

According to yet another aspect of the present invention, there is provided a reciprocating pump for delivering fluid, which includes: a first diaphragm and a second diaphragm that are reciprocated to deliver fluid; diaphragm drive chambers respectively provided therein with the first and second diaphragms; and a drive-power supply member for supplying drive power for reciprocating the first and second diaphragms. The drive-power supply member includes a single eccentric cam, and a first piston member and a second piston member that are reciprocated by the rotation of the single eccentric cam. In this arrangement, drive powers of the first and second piston members are transmitted to the first and second diaphragms via operating fluid. An auxiliary drive member is provided so as to deliver fluid into fluid delivery sections respectively provided within the diaphragm drive chambers. The auxiliary drive member includes a first auxiliary diaphragm and a second auxiliary diaphragm that are reciprocated so as to deliver fluid, and an auxiliary eccentric cam for reciprocating the first and second auxiliary diaphragms. The auxiliary eccentric cam is rotated by means of a drive-power transmission shaft for driving the single eccentric cam. Check valves are respectively provided on the upstream sides and downstream sides of each of the first and second diaphragms. Each of the check valves includes a valve body having a fluid communication passage and a valve element provided within the valve body so as to open and close the fluid communication passage, in which electromagnet means is provided at least in or around the valve body. The valve element is made of a magnetic material. At least one of a timing at which electricity is sent to the electromagnet means and a timing at which the polarity of electricity sent to the electromagnet means is determined according to a timing at which the fluid communication passage is opened and closed by the valve element. When the electromagnet means is provided in the valve body in the above arrangement, it is not provided in the fluid communication passage but in a wall part defining the fluid communication passage. Also, as an alternative to separately providing the electromagnet means, the valve body itself may serve as an electromagnet means.

Preferably, a capacitor is provided in an electric power supply line to the electromagnet means. With this arrangement, it is possible to provide the check valve that exhibits a high response capability in closing operation, hence enabling the reciprocating pump to deliver fluid at a precisely controlled constant rate.

According to another aspect of the present invention, there is provided a reciprocating pump that is made up by using first and second diaphragms that are reciprocated in contact with fluid to be delivered, in which a wetted surface of the first diaphragm and a wetted surface of the second diaphragm are positioned facing each other substantially in parallel relationship with each other via pump head having a fluid delivery passage. A fluid delivery region is formed by the wetted surfaces of the first and second diaphragms, and the pump head.

Herein, the term, "fluid delivery region" is meant as a region that is capable of delivering fluid by driving the respective diaphragms (the first and second diaphragms) without leaking fluid to any portions other than a conduit connected with the fluid delivering passage of the pump head (a passage formed in the pump head through which fluid is delivered).

With the above arrangement having the two diaphragms positioned facing each other via the pump head, it is possible to greatly reduce the number of constitutional parts of the reciprocating pump in comparison with a pump having simply two independent pump heads. Along with this reduction of the number of parts, the number of sealing members can be reduced so that the possibility of fluid leakage can be reduced corresponding to the reduced number of sealing members. Also, this reduction of the number of parts can reduce the number of manufacturing errors of these parts and the frequency of errors during assembling the parts. Furthermore, since the pump head is located between the diaphragms positioned facing each other, the first diaphragm is unlikely to cause an undesirable influence on the second diaphragm, or vice versa, so that the respective diaphragms can be properly operated as expected. With the thus formed reciprocating pump, the discharge rates of the diaphragms can be properly maintained, while preventing the pulsation of fluid during its delivery.

In the reciprocating pump of the present invention, the diaphragms and the pump head together preferably make up a fluid communication block, which is detachable from the reciprocating pump without leaking fluid from the fluid delivery region. With such a detachable construction, efficient maintenance is possible. That is, conduits or other parts can be detached from the pump so as to perform maintenance operation of the drive-power supply member (e.g., the eccentric cam, the urging member for positional regulation, or any other replacement parts and members) without necessity to dissemble the fluid communication block. Therefore, the maintenance can be performed in a simple manner as compared with the maintenance for a conventional pump, which has two independent pump heads, for which independent and separate disassembling and assembling operations must be performed. As a result, it is possible to provide the reciprocating pump that presents excellent maintenance capability, enabling the maintenance operation on the drive-power supply member, and other parts and members to be performed without the necessity to previously remove fluid communicating in the fluid communication block.

According to another aspect of the present invention, there is provided a reciprocating pump that includes a diaphragm that is reciprocated in contact with fluid to be delivered, a drive-power supply member for driving the diaphragm. The drive-power supply member includes a single eccentric cam, a first piston member and a second piston member that are reciprocated by the rotation of the single eccentric cam, and an adjusting means for adjusting the positions of the first and second piston members. The adjusting means is capable of urging the first and second piston members towards the single eccentric cam, and absorbing slippage between the first and second piston members due to varied width across corner of the single eccentric cam.

With the above arrangement enabling the two piston members to be driven by the single eccentric cam, it is not required to have two eccentric cams for which the identical shape must be applied. As a result, the reciprocating pump and the respective parts can be efficiently manufactured and assembled without requiring a high assembling accuracy unlike the conventional pump using two eccentric cams.

Preferably, the second piston member has a hollowed-out area, in which the single eccentric cam and the first piston member are located. The adjusting means is located between an outer surface of the first piston member and an inner surface of the second piston member, so that the first piston member and the second piston member are reciprocated along with the adjusting means by the rotation of the single eccentric cam.

With the above arrangement, the piston members are reciprocated, as sliding relative to each other with the adjusting means (the urging member for positional regulation) held therebetween by the rotation of the single eccentric cam. Therefore, the maximum bending length of the adjusting means can be remarkably shortened relative to the reciprocating distance of the piston members. As a result, it is possible to make up the adjusting means by using an urging member (such as a spring) having a small size and low strength, and hence achieve the downsizing of the reciprocating pump.

Preferably, in the reciprocating pump, the reciprocating direction of the first and second piston members is set substantially parallel to the urging direction and shock-absorbing direction of the adjusting means.

Preferably, in the reciprocating pump, the adjusting means is made up by using an urging member such as a single spring.

Preferably, in the reciprocating pump, a first space is defined between an end face of the first piston member and a first diaphragm, and a second space is defined between an end face of the second piston member and a second diaphragm. These spaces are substantially hermetically sealed and filled with operating fluid so that pressure is applied to the operating fluid based upon the reciprocating motions of the first and second piston members, thereby reciprocating the first and second diaphragms upon receiving this pressure.

With the above arrangement, drive power from the piston members can efficiently be transmitted to the diaphragms. As a result, the reciprocating pump can be downsized by using the drive-power supply member, which produces various desirable effects as mentioned above.

According to still another aspect of the present invention, there is provided a reciprocating pump that includes a diaphragm, which is reciprocated in contact with fluid to be delivered and a drive-power supply member for driving the diaphragm. The drive-power supply member includes a single eccentric cam, a first piston member and a second piston member that are reciprocated by the rotation of the single eccentric cam, and rotation elements (rotation shafts), which rotate in contact with the single eccentric cam. The rotation elements each have a diameter smaller than the diameter of the single eccentric cam so as to have a limited pressure angle relative to the single eccentric cam. That is, in the reciprocating pump of this embodiment, the rotation elements each preferably have a minimized size.

With the above arrangement having the rotation elements minimized in size, the pressure angle relative to the single eccentric cam can be decreased. As a result, the reciprocating pump can be used over the long time and operated in such a manner as to deliver fluid without pulsation for a long time.

Further, in the reciprocating pump of the present invention, the piston members are respectively provided with bearings, each of which has an inner ring unit having a plurality of rings for receiving a corresponding one of the rotational elements (the rotational shafts). With this arrangement, the single eccentric cam contacts the rotational elements along an inner diameter side of each of the ring unit, so that the pressure angle between the single eccentric cam and each of the rotation elements (the rotation shafts) can be decreased as compared with the arrangement with the eccentric cam contacting each rotation element along an outer diameter side thereof. As a result, the reciprocating pump can be used for the long time.

In the reciprocating pump of the present invention, the first and second piston members each are preferably provided with two or more bearings, and the rotation elements (the rotation shafts) so as to be supported by the corresponding bearings and the single eccentric cam. With this arrangement, it is possible to provide the rotation elements of a required minimum size regardless of the size of each bearing or the single eccentric cam, provided that the rotation elements (the rotation shafts) have a given strength or the like. Thus, the reciprocating pump can be used for the-long time by decreasing the pressure angle.

Also, in the reciprocating pump of the present invention, an adjusting means may be provided to adjust the positions of the first and second piston members. This adjusting means is preferably capable of urging the rotation elements provided on the first and second piston members towards the single eccentric cam, and absorbing a clearance between the first and second piston members due to varied width across corner of the single eccentric cam. The adjusting means may be made up by using an urging member such as a spring.

According to another aspect of the present invention, there is provided a reciprocating pump, which includes a diaphragm that is reciprocated in contact with fluid to be delivered, and a drive-power supply member for driving the diaphragm. The drive-power supply member includes a single eccentric cam, a first piston member and a second piston member that are reciprocated by the rotation of the single eccentric cam, and rotation elements (rotation shafts), which rotate in contact with the single eccentric cam so as to transmit drive power of the eccentric cam to the respective piston members. The reciprocating pump further includes an adjustment mechanism for adjusting the drive state of the diaphragm.

With the adjustment mechanism, which can properly adjust the drive state of the diaphragm, even if pulsation or the like is caused on the discharge side of the reciprocating pump, the diaphragm can be driven so as to compensate the flow rate of fluid decreased due to the pulsation on the discharge side of the reciprocating pump. Thus, it is possible to provide the reciprocating pump that is capable of effectively preventing the pulsation.

The reciprocating pump of the present invention is so structured to transmit the drive power of the piston members to the diaphragm via operating fluid. In this structure, the aforesaid adjustment mechanism preferably includes an auxiliary plunger being driven in response to the motions of the piston members, and an adjustment plunger for adjusting the operation time of the auxiliary plunger so as to adjust the drive state of the diaphragm by applying pressure to operating fluid.

With the above arrangement, even if the pulsation or the like is caused on the discharge side of the reciprocating pump, the diaphragm can be driven so as to compensate for the flow rate of fluid decreased due to the pulsation by applying pressure to operating fluid by the auxiliary plunger. Thus, it is possible to provide the reciprocating pump that is capable of effectively preventing pulsation.

In the reciprocating pump of the present invention, the adjustment plunger is preferably designed so that a clearance between the auxiliary plunger and the adjustment plunger regulates the operation time of the auxiliary plunger, and this clearance can be optionally determined. With this arrangement enabling the operation time of the auxiliary plunger to be optionally determined, various types of pulsation, which may occur in each of different pumps, can be effectively prevented by a proper adjustment for every pump by using the adjustment plunger. As a result, it is possible to provide the reciprocating pump that is capable of effectively preventing the pulsation.

The drive-state adjustment mechanism in the reciprocating pump of the present invention preferably includes a variable speed motor for driving the single eccentric cam, a rotational-position detection device for detecting the rotational position of the single eccentric cam, and a control means for controlling the variable speed motor based upon signals representative of the rotational position of the single eccentric cam detected by the rotational-position detection device.

With the above arrangement, in which the variable speed motor can be properly controlled by using the positional signals and the control means, the rotational speed of the single eccentric cam, which drives the diaphragm, can be properly controlled. Thus, even if pulsation is caused, it can be effectively stopped by controlling the drive state of the diaphragm by controlling the rotation of the single eccentric cam according to needs.

The reciprocating pump of the present invention is preferably provided with a pulsation detection means on the discharge side of a fluid delivery path. This pulsation detection means detects pulsation and feeds back signals representative of detected pulsation to the control means so that the variable speed motor is controlled based upon the positional signals, pulsation signals and the control means. Herein, as the pulsation detection means, a flow meter, a pressure gauge, or any other detection means is preferably used, provided that they can detect pulsation of fluid to be delivered.

In the reciprocating pump of the present invention, the variable speed motor is preferably a stepping motor. Also, the rotational-position detection device is preferably a rotary encoder or a tachogenerator.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

The description will be made for the embodiments of the present invention with reference to the accompanied drawings.

Figure 1:
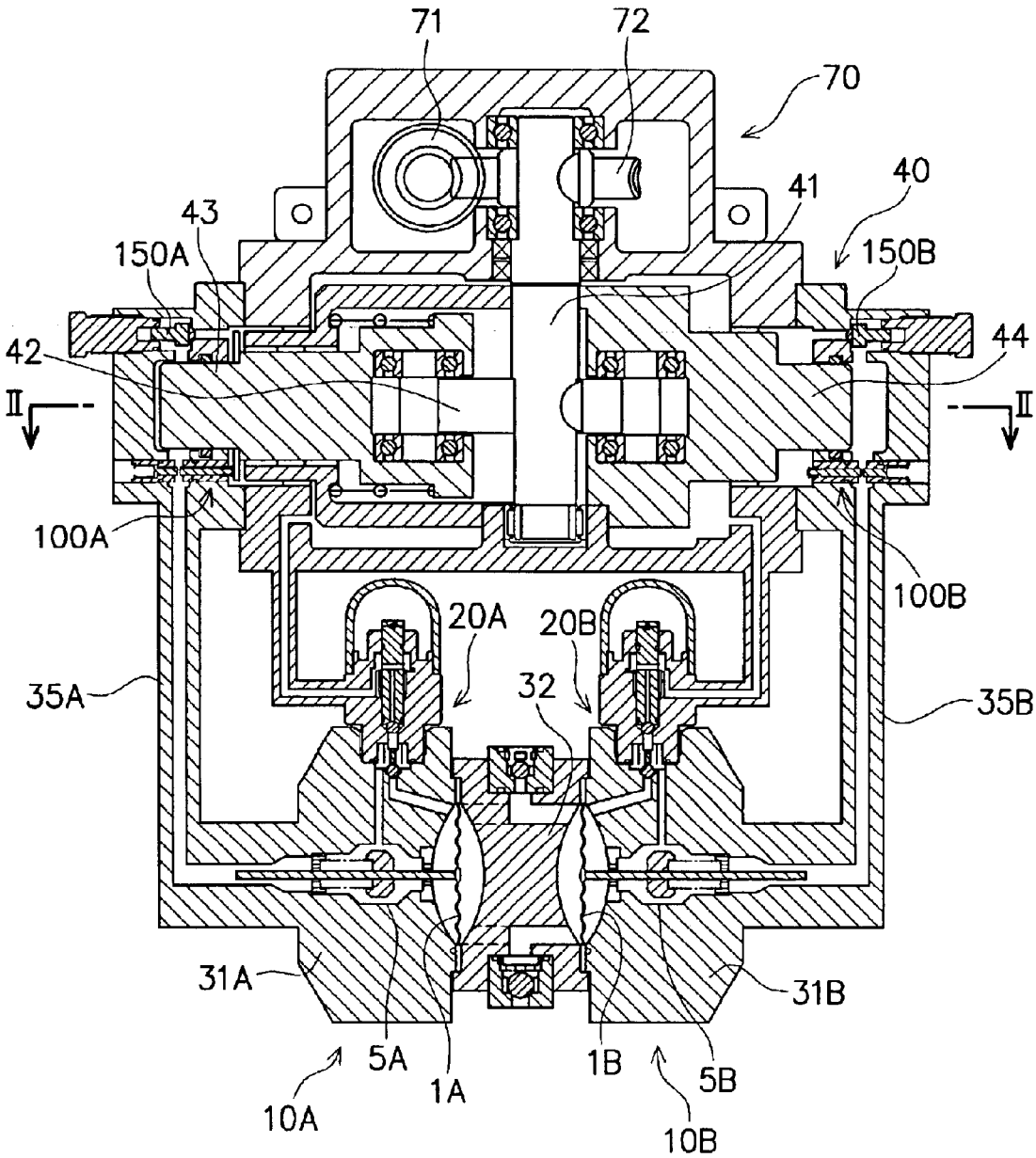
FIG. 1 is a schematic cross section of a reciprocating pump according to a first embodiment of the present invention.

FIG. 1 is a schematic cross section of the reciprocating pump according to the first embodiment of the present invention. As illustrated in this Figure, the reciprocating pump of this embodiment includes two fluid delivery paths 10A, 10B for delivering fluid by reciprocating diaphragm means (first diaphragm 1A and second diaphragm 1B), drive-power supply member 40 for supplying operating fluid at a proper timing intervals so as to drive these diaphragms 1A, 1B, and drive member 70 for driving eccentric cam 42 of the drive-power supply member 40.

The drive member 70 as a constitutional element of the reciprocating pump includes electric motor 71 producing rotational motion, and gear member 72 for transmitting rotational power from the electric motor 71 to drive-power transmission shaft 41. Also, in this embodiment, auxiliary plunger mechanisms 100A, 100B (corresponding to operating-fluid replenishing means of the present invention), and operating-fluid replenishing valves 150A, 150B (corresponding to the operating-fluid replenishing means of the present invention). These members will be later described in detail.

The reciprocating pump of this embodiment employs two fluid delivery paths 10A, 10B for the purpose of preventing pulsation. These members basically have the same construction except for difference in actuation timing. In order to match the reciprocating pump of this embodiment to these two fluid delivery paths 10A, 10B, two elements for each function, such as the auxiliary plunger mechanisms 100A, 100B and the operating fluid replenishing valves 150A, 150B are also arranged.

Accordingly, in the following description, corresponding or identical elements have been given the same reference characters, while "A", "B" are given to those reference characters when a different description will be needed for each element.

Figure 2:
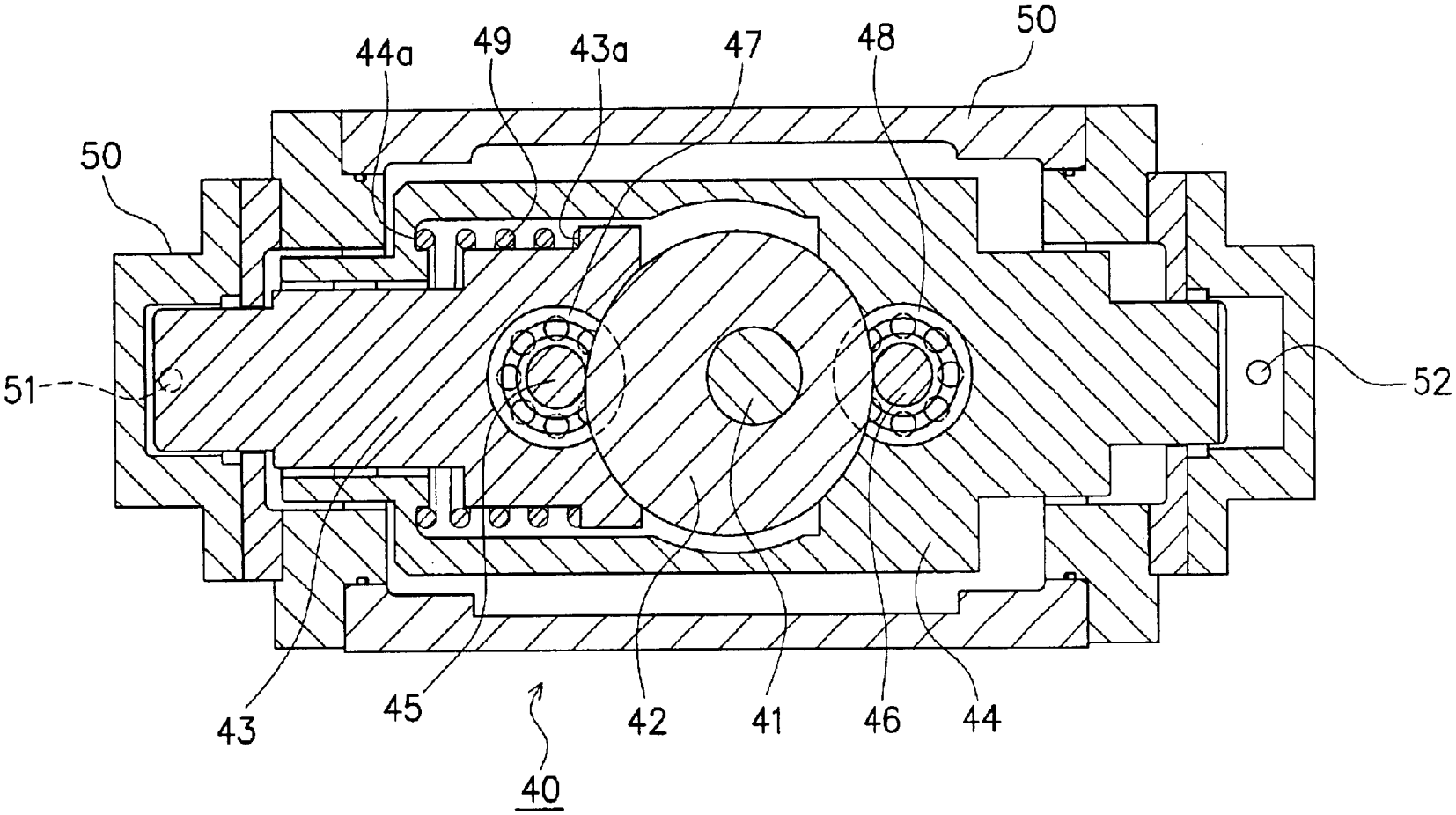
FIG. 2 is a cross section taken along a line II—II in FIG. 1.

FIG. 2 is a cross section taken along a line II—II in FIG. 1, and more specifically a cross section of the drive-power supply member 40. In this Figure, an auxiliary plungers is not illustrated.

As illustrated in FIG. 2, the drive-power supply member 40 includes drive-power transmission shaft 41 for receiving drive power from the aforesaid drive member 70, eccentric cam 42 mounted on the drive-power transmission shaft 41, piston means in the form of first piston member 43 and second piston member 44 that are reciprocated in response to the motion of the eccentric cam 42, first rotation shaft 45 supported by an inner ring unit of bearing 47 within the first piston member 43, second rotation shaft 46 supported by an inner ring unit of bearing 48 within the second piston member 44, urging member 49 as an adjusting means for positional regulation, which properly urges the first piston member 43 and the second piston member 44 within the second piston member 44 so as to bring the respective rotation shafts 45, 46 disposed within the piston members 43, 44 into contact with the eccentric cam 42, and casing member 50 for enclosing these elements. The drive-power supply member 40 having these elements forms a sealed space between an inner wall of the casing member 50 and the piston members 43, 44. The sealed space is filled with operating fluid.

In the drive-power supply member 40 of this embodiment, the second piston member 44 has a hollowed-out area. Specifically, the second piston member 44 is formed so as to be capable of accommodating in the hollowed-out area the drive-power transmission shaft 41, the eccentric cam 42, the first piston member 43, the bearing 48, the urging member 49, and the like. The urging member 49 is held between inner wall (inner surface) 44*a* of the second piston member 44 and an outer wall (outer surface) 43*a* of the first piston member 43. Specifically, the first and second piston members 43, 44 are urged towards the eccentric cam 42 by the urging member 49. In other words, the first rotation shaft 45 within the first piston member 43 and the second rotation shaft 45 within the second piston member 44 are urged so as to constantly contact the outer circumference of the eccentric cam 42 through proper urging force exerted by the urging member 49.

The casing member 50 forms operating-fluid supply port means (first supply port 51 and second supply port 52) so as to provide fluid communication between respective conduits (later described). A space, which extends from end faces of the piston members 43, 44 to diaphragms 1, 2 through the supply ports 51, 52, conduits 21, 22 and the like, is substantially hermetically sealed and filled with operating fluid. Accordingly, in this embodiment, positive and negative pressures are applied to operating fluid in response to the motions of the piston members 43, 44, so that this pressure variation enables communication of operating fluid via the first and second supply ports 51, 52. Thus, this operating fluid causes the diaphragms 1, 2 to be reciprocated.

Figure 3:
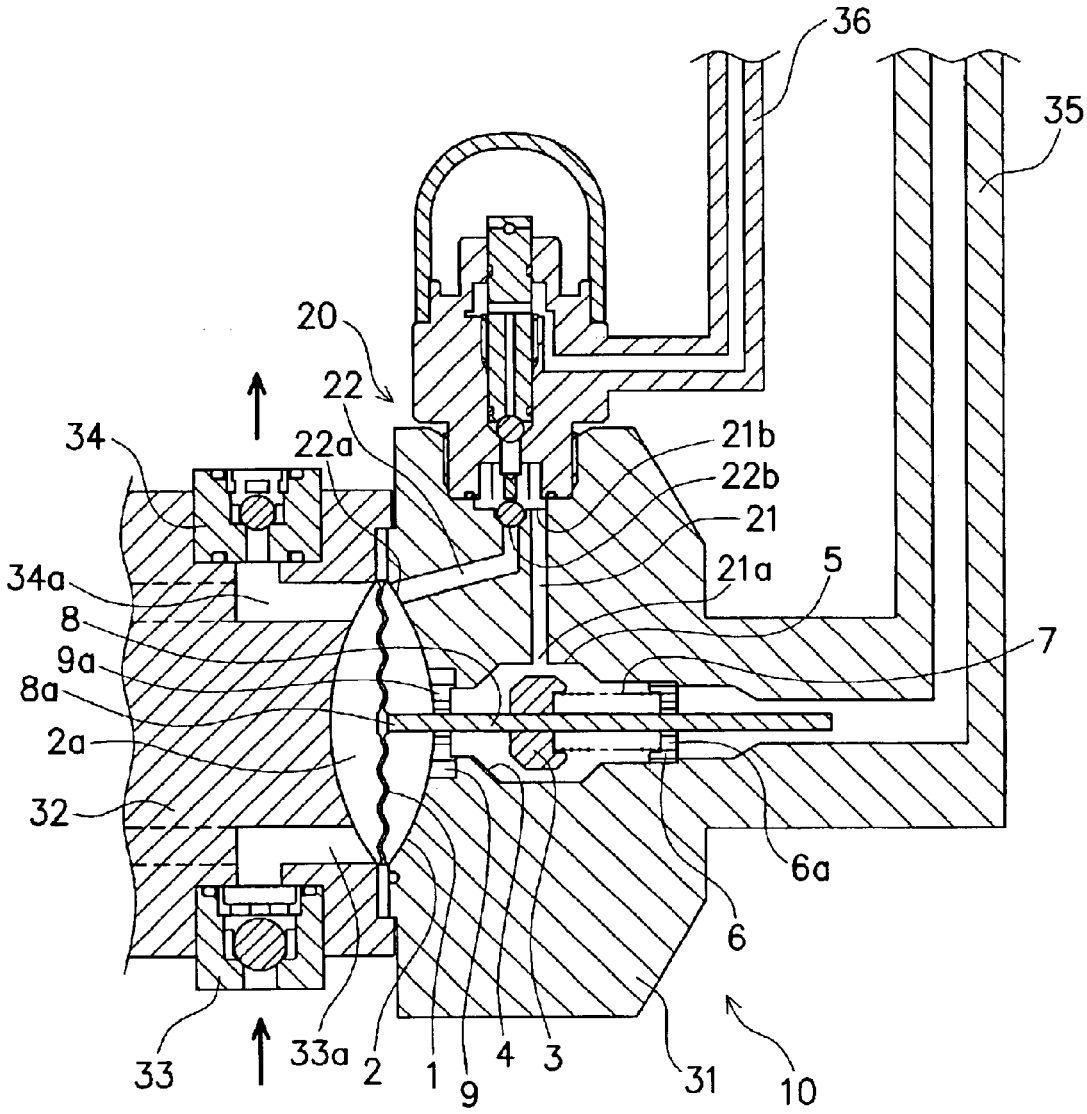
FIG. 3 is an enlarged view of a fluid delivery path as a constitutional element of the reciprocating pump of the first embodiment.

FIG. 3 is an enlarged view of a portion of the reciprocating pump of FIG. 1, and more specifically an enlarged view of fluid delivering means 10. As described above, the reciprocating pump of this embodiment is made up by using the two fluid delivery paths 10A, 10B, which basically have the identical structure. Accordingly, "A", "B" given to the reference codes for distinguishing the right one from the left one will be omitted. When the needs arises to distinguish the left and right elements from each other, "A" for the left one and "B" for the right one are respectively given to the reference codes in the following description.

As illustrated in FIG. 3, in this embodiment, the diaphragms 1A, 1B are clamped by using pump head 32, and left and right operating-fluid supply members 31A, 31B, thereby making up the fluid delivery paths 10A, 10B. Specifically, the fluid delivery paths 10 includes the diaphragms 1, the pump head 32, the operating-fluid supply members 31 clamping and supporting the diaphragms 1 in cooperation with the pump head 32, and gas discharge mechanisms 20 disposed on an upper portion of the diaphragms 1.

Diaphragm drive chambers 2 respectively equipped with the diaphragms 1 are formed by the operating-fluid supply members 31 and the pump head 32. Operating-fluid-flow regulation chambers 5, which are respectively formed within the operating-fluid supply members 31, are respectively equipped with valve elements 3 adjacent to the corresponding diaphragms 1 and corresponding valve seats 4. The aforesaid gas discharge mechanisms 20 are provided to properly discharge gas such as air mixed into operating fluid within the diaphragm drive chambers 2 and the operating-fluid-flow regulation chambers 5. The pump head 32 is also provided with inflow-side check valve 33 for allowing inflow of fluid and outflow-side check valve 34 for allowing outflow of fluid. These are communicated with fluid delivering sections 2*a* of the diaphragm drive chambers 2 respectively via inflow passages 33*a* and outflow passages 34*a*.

In the diaphragm drive chambers 2, drive power from the aforesaid drive member 70 is received by the diaphragms 1 via the drive-power supply member 40. The diaphragms 1 are thus reciprocated upon receiving this drive power. Specifically, the drive-power supply member 40 is communicated with the operating-fluid supply members 31 via the operating-fluid conduits 35, in which the operating-fluid conduits 35 and the operating-fluid supply members 31 are filled with operating fluid, so that reciprocating motions of the first piston member 43 and the second piston member 44 are transmitted to the diaphragms 1 via operating fluid within the operating-fluid conduits 35 and the operating-fluid supply members 31. Now, it is to be noted that the diaphragms 1 each are not limited in shape to a corrugated cross section, but may be shaped in various forms according to needs.

As described above, each of the operating-fluid-flow regulation chamber 5 is provided therein with the valve element 3 and the valve seat 4 provided as corresponding thereto, in which the valve element 3 is mounted to valve-element support member 6 via biasing means 7 such as a coil spring, and then secured to shaft 8 extending between the operating-fluid-flow regulation chamber 5 and the diaphragm drive chambers 2. The shaft 8 has first end 8*a* urged towards the diaphragms 1 via the biasing means 7 and the valve element 3, enabling the shaft to contact a side of the diaphragm 1 closer to the operating-fluid supply member 31 during a normal operation.

The operating-fluid-flow regulation chambers 5 are provided to regulate the flow of operating fluid supplied to the diaphragms 1, thereby preventing the diaphragms 1 from being excessively reciprocated over a given reciprocating range. The detailed description on this operation will be later described.

The description hereinbelow will be made for the elements in one of the fluid delivery paths 10A, 10B so that only one of the two elements for each function will be discussed. Accordingly, the same description will be applied to another fluid delivery path, unless a contrary provision is made.

Shaft-support member 9 is provided between the operating-fluid-flow regulation chamber 5 and the diaphragm drive chamber 2, which forms through-hole 9*a* for communication of operating fluid. The valve-element support member 6 also forms through-hole 6*a* for communication of operating fluid.

In this embodiment, as illustrated in FIG. 3, if gas such as air is mixed into operating fluid, it is likely to stay in an uppermost region of the diaphragm drive chamber 2 and the operating-fluid-flow regulation chamber 5. In order to properly discharge the gas from the diaphragm drive chamber 2 and the operating-fluid-flow regulation chamber 5, the gas discharge mechanism 20 is provided. Next, the structure of the gas discharge mechanism 20 will be described with reference to FIG. 4.

Figure 4:
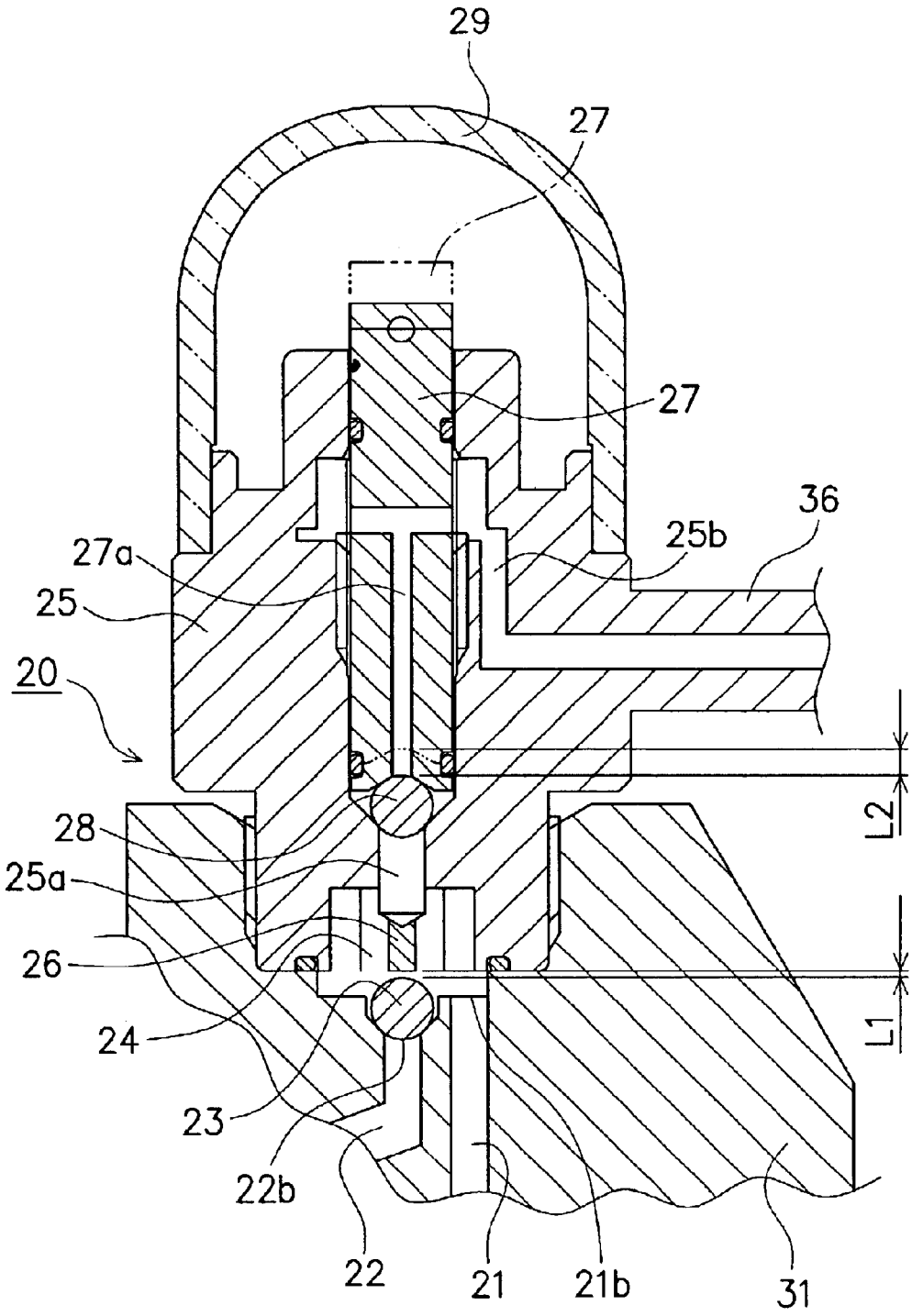
FIG. 4 is an enlarged view of a gas discharge mechanism as a constitutional element of the reciprocating member of the first embodiment.

FIG. 4 is an enlarged view of the gas discharge mechanism of this embodiment. In the gas discharge mechanism 20 of this embodiment, the operating-fluid-flow regulation chamber 5 is provided with first gas-discharge passage 21 (corresponding to a first gas discharge member of the present invention), while the diaphragm drive chamber 2 is provided with second gas-discharge passage 22 (corresponding to a second gas discharge member of the present invention).

More specifically, the first gas-discharge passage 21 has first end 21*a* located in an upper part of the inside of the operating-fluid-flow regulation chamber 5 closer to the operating-fluid conduit 35 than the valve seat 4 (see FIG. 3), while the second gas-discharge passage 22 has first end 22*a* located in an upper part of the inside of the diaphragm drive chamber 2 between the diaphragm 1 and the valve seat 4 (see FIG. 3). These discharge passages 21, 22 also have second ends 21*b*, 22*b* located closer to each other so as to be communicated with communication member 24 formed by fluid-discharge-adjusting member 25 and the operating-fluid supply member 31. Also, first ball member 23 (corresponding to a reverse-flow prevention member of the present invention) rests on the second end 22*b* of the second gas-discharge passage 22, and regulation member 26 for regulating a lift amount or movable range of the first ball member 23 is provided above the fist ball member 23.

The fluid-discharge-adjusting member 25 has first-adjustment-member-discharge passage 25*a* provided with second ball member 28 (corresponding to a ball member of the present invention) for stopping outflow of gas discharged from the communication member 24 or discharging a given amount of gas discharged therefrom, and is provided with adjustment valve 27 for regulating a lift amount or movable range of the second ball member 28 and communicating gas discharged via the first-adjustment-member-discharge passage 25*a*.

The adjustment valve 27 has inside discharge passage 27*a* and an outer circumference on which an outwardly threaded portion is formed so as to be threaded with the fluid-discharge-adjusting member 25. The lift amount of the second ball member 28 is adjusted based upon the screw-in depth of this adjustment valve 27. The inside discharge passage 27*a* of the adjustment valve 27 is designed to be capable of being communicated with second-adjustment-member-discharge passage 25*b* formed in the fluid-discharge-adjusting member 25. The second-adjustment-member-discharge passage 25*b* is in turn communicated with gas discharge conduit 36 connected with an operating-fluid storing member (the casing member 50). Provided above the adjustment valve 27 of the fluid-discharge-adjusting member 25 is protection cover 29, which is detachably attached over the adjustment valve 27 or is provided so that it can be opened and closed.

Now, the description will be made for the function of the reciprocating pump in the normal operation with reference to FIGS. 1–4.

In the reciprocating pump of this embodiment, the electric motor 71 is first rotated so as to transmit rotational power to the drive-power transmission shaft 41 via the gear member 72.

Then, the eccentric cam 42 is rotated by the drive-power transmission shaft 41 so as to reciprocate the first and second piston members 43, 44. Herein, the first and second piston members 43, 44 are integrally reciprocated by the single eccentric cam 42 according to the above described structure. The reciprocating motions of these piston members 43, 44 cause a given magnitude of force and a directional pressure on operating fluid, which is then fed/discharged to the conduits 35A, 35B via the first and second supply ports 51, 52.

The diaphragms 1A, 1B are reciprocated at proper timings based upon the operating fluid circulating via the conduits 35A, 35B, thereby actuating the inflow-side check valve 33 and the outflow-side check valve 34 so as to deliver a given fluid.

In the normal operation, the reciprocating pump of this embodiment is capable of constantly delivering fluid by repeated reciprocating motions of the diaphragms 1A, 1B by the operation of the respective elements as describe above. For coping with cracks or damages of the diaphragm 1 due to excessive pressure applied thereto via operating fluid from the drive-power supply member 40, or an excessive volume of operating fluid supplied to the diaphragm drive chamber 2, the operating-fluid-flow regulation chamber 5 is provided in this embodiment, a concrete explanation of which will be hereinbelow described.

The valve element 3 is moved along with the diaphragm 1 by operating fluid flowing into the operating-fluid supply member 31 via the operating-fluid conduit 35, in this embodiment. Therefore, when operating fluid of a volume larger than that for the normal operation flows into the operating-fluid supply member 31, not only the diaphragm 1 but also the valve element 3 move towards the diaphragm 1 due to excessive operating fluid. In this embodiment, the valve element 3 is designed to be held in contact with the valve seat 4 before the diaphragm 1 is cracked or suffered any other damages. The contact of this valve element 3 with the valve seat 4 can achieve a proper limitation of the supply of operating fluid to the diaphragm drive chamber 2.

In this embodiment, as described above, the valve element 3 is driven along with the diaphragm 1 according to the feed rate (pressure) of operating fluid, and contacts the valve seat 4 according to needs so that operating fluid to be distributed into the diaphragm drive chamber 2 via the through-hole 9*a* of the shaft-support member 9 can be shut off. Thus, pressure applied to the diaphragm 1 via operating fluid can be properly limited.

The operating fluid thus properly limited by the operating-fluid-flow regulation chamber 5 (or the valve element 3 and the valve seat 4 constituting the chamber 5) has nowhere to flow. This operating fluid with nowhere to flow is properly escaped by a relief mechanism (not shown) between the drive-power supply member 40 and the operating-fluid-flow regulation chamber 5, and then returned to the casing member 50, which constitutes the drive-power supply member 40, or any other place.

The operating fluid that is restrained from flowing by the operating-fluid-flow regulation chamber 5 can also overflow through the first gas-discharge passage 21 provided in the operating-fluid-flow regulation chamber 5. When the second ball member 28 is pressed against the fluid-discharge-adjusting member 25 with causing no clearance therebetween by the adjustment valve 27 at this moment, the operating fluid overflowed from the first gas-discharge passage 21 is stored in the communication member 24. In this embodiment, an upper end (the second end 22*b*) of the second gas-discharge passage 22 is provided with the first ball member 23, so that operating fluid, even if it has overflowed via the first gas-discharge passage 21, does not reversely flow into the second gas-discharge passage 22.

Where a given clearance is set between the second ball member 28 and the adjustment valve 27, operating fluid overflowed to the first gas-discharge passage 21 is returned into the casing member 50 via the communication member 24, the first-adjustment-member-discharge passage 25*a*, the inside discharge passage 27*a,* the second-adjustment-member-discharge passage 25*b* and the gas discharge conduit 36. Also, in this case, the first ball member 23 provided on the upper end (the second end 22*b*) of the second gas-discharge passage 22 prevents operating fluid from reversely flowing into the second gas-discharge passage 22 in the same manner as above.

In this embodiment, for the diaphragm 1, which is likely to receive excessive load due to any fault, the valve element 3 and the like thus function to protect the diaphragm 1, as described above.

Now, the description will be made for the discharging operation of gas, which may intrude into the diaphragm drive chamber 2 and the operating-fluid-flow regulation chamber 5 of the reciprocating pump according to this embodiment.

First, it is to be noted that the gas discharge operation of the both chambers 2, 5 can be manually and automatically made by means of the gas discharge mechanism 20, which includes the fluid-discharge-adjusting member 25 and the like.

The manual gas discharge operation is made in the following manner.

As illustrated in FIG. 4 and other Figures, for the manual operation, the second ball member 28 is pressed against the upper end of the first-adjustment-member-discharge passage 25*a* by means of the adjustment valve 27. In this pressing state, gas within the diaphragm drive chamber 2 and the operating-fluid-flow regulation chamber 5 is discharged respectively through the second gas-discharge passage 22 and the first gas-discharge passage 21 into the communication member 24 and then stored therein. In this stored state, the first ball member 23, which is provided on the second gas-discharge passage 22 with a given clearance (e.g., 1 mm) between the first ball member 23 and the regulation member 26, is lifted up upon receiving the pressure of the discharged gas, thereby enabling gas to be discharged therethrough and stored in the communication member 24.

In this embodiment, a given clearance is provided between the second ball member 28 and the adjustment valve 27 by adjusting the screw-in depth of the adjustment valve 27 and hence moving the adjustment valve 27 upward, according to needs and more specifically if there arises a need to discharge gas. The thus provided clearance can allow the second ball member 28 to be lifted up by the pressure of the discharged gas within the communication member 24 and gas within the diaphragm drive chamber 2 and the operating-fluid-flow regulation chamber 5 to be properly discharged through the first-adjustment-member-discharge passage 25*a*, the inside discharge passage 27*a*, the second-adjustment-member-discharge passage 25*b* and the gas discharge conduit 36. Upon finishing the gas discharge operation, the adjustment valve 27 is again screwed in so as to set a clearance between the second ball member 28 and the adjustment valve 27 or lifting range, within which the second ball member 28 can be lifted at the "O" setting.

The arrangement with the second ball member 28 having a lifting range (the clearance between the adjustment valve 27 and the second ball member 28, or the lifting range within which the second ball member 28 can be lifted) set at "0" setting can secure a hermetically sealed condition of the diaphragm drive chamber 2 and the operating-fluid-flow regulation chamber 5, preventing leakage of gas and operating fluid to the outside. Therefore, the reciprocating pump can be driven in a condition allowing the pump to exhibit a maximum performance.

Also, as described above, it is enough to operate the single adjustment valve 27 for discharging gas from the two difference places according to needs. This arrangement makes the gas discharge (degasification) operation easier than the conventional arrangement. The gas discharge operation or the adjustment operation of the adjustment valve 27 is not basically required to be made somewhat frequently, provided it is made at the time of manufacturing the reciprocating pump.

Now, the description will be made for the automatic gas discharge operation.

For the automatic operation, it is necessary to set each of the clearance L1 between the first ball member 23 and the regulation member 26 (the lift range within which the first ball member 23 can be lifted) (hereinafter referred to "first lift amount"), and the clearance L2 between the second ball member 28 and the adjustment valve 27 (the lift range within which the second ball member 28 can be lifted) (hereinafter referred to "second lift amount), which is the one as illustrated in chain double-dashed line (phantom line), at a given clearance. Herein, the "given clearance" is meant as a clearance which enables gas discharged through the first and second gas-discharge passages 21, 22 to be properly discharged therethrough without a substantial deterioration of the pump discharge efficiency, as well as enables the reciprocating pump to be driven with suppressing pulsation. This "given" clearance is therefore varied according to the discharge rate of the pump and the like. For example, the first lift amount L1 is preferably set at about 0.5 mm–2.0 mm and more preferably about 1.0 mm–1.5 mm, while the second lift amount L2 is preferably set at about 0.5 mm–2.0 mm and more preferably about 0.5 mm–1.0 mm. In this embodiment, the regulation member 26 is of a fixed type and has the first lift amount L1 set at about 1.0 mm. Since the second lift amount L2 is variable by the adjustment valve 27, it may be set to for example about 1.0 mm or a more proper value according to needs so as to properly discharge gas without deterioration of the pump discharge efficiency. In order to secure a properly and hermetically sealed condition while performing a proper gas discharge operation, it may be necessary to properly select materials from which the respective ball members 23, 28 are formed. For example, the first ball member 23 is preferably made of polypropylene or any other material having a specific gravity being approximate to that of operating fluid.

The arrangement with the first lift amount L1 and the second lift amount L2 thus set at given values can allow gas to be properly and automatically discharged (degasification or the like) via the first gas-discharge passage 21, the second gas-discharge passage 22, the communication member 24, the first-adjustment-member-discharge passage 25*a* and the inside discharge passage 27*a* even if gas intrudes into the diaphragm drive chamber 2 and the operating-fluid-flow regulation chamber 5 in the normal operation thanks to the ball members 23, 28 which can be lifted by given amounts.

As described above, in this embodiment, there is likelihood that not only gas but also operating fluid are simultaneously discharged during the gas charge operation in either of the manual and automatic operations. Discharging of operational fluid may deteriorate the pump discharge efficiency and increase pulsation. In order to avoid these problems, the auxiliary plunger mechanism 100 is provided in this embodiment to replenish the amount of operating fluid discharged along with gas and hence prevent the deterioration of the pump efficiency during the degasification (see FIG. 1). Hereinafter, the description will be made for the plunger mechanism 100 with reference to FIGS. 1, 5 and 6.

As illustrated in FIG. 1, in this embodiment, the auxiliary plunger mechanisms 100A, 100B, which are located near the first and second piston members 43, 44 with the eccentric cam 42 therebetween, have basically the identical structure. Accordingly, the following description with reference to FIGS. 5 and 6 will be made only for the auxiliary plunger mechanism 10A, which is located at the left-hand side. In FIGS. 5 and 6, the symbol "A" affixed to elements for representing the elements at the left hand side will be omitted.

As described above, in the reciprocating pump of this embodiment, a slight amount of operating fluid is discharged along with gas during the gas discharge operation. Therefore, the plunger mechanism 100 of this embodiment adjusts a pressure magnitude applied to operating fluid basically for the purpose of replenishing the amount of operating fluid discharged and properly driving the diaphragm 1.

Figure 5A:
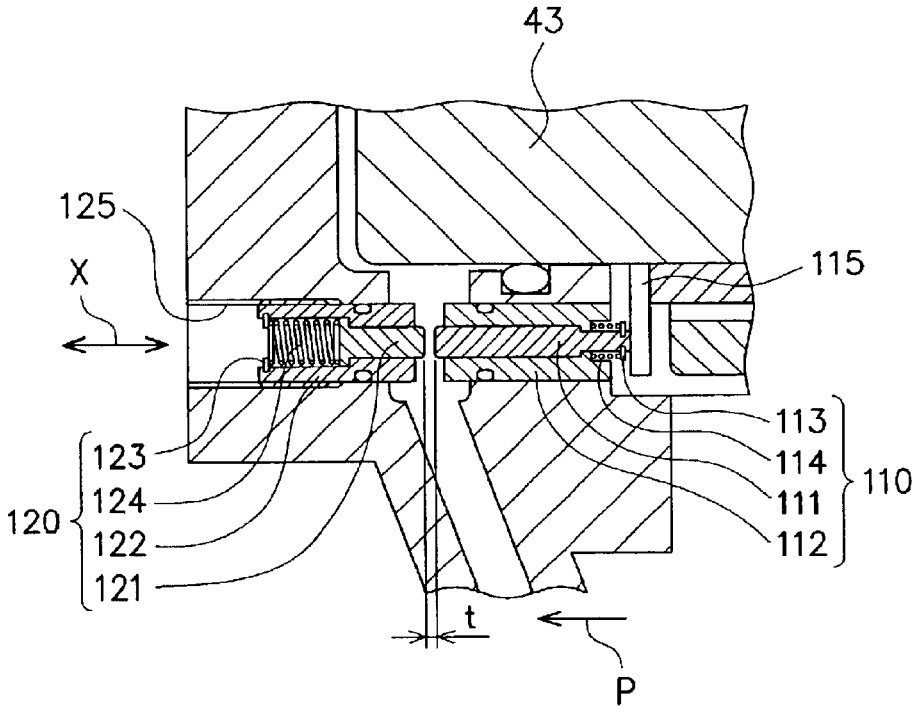
FIGS. 5A and 5B are enlarged views of an auxiliary plunger mechanism as a constitutional element of the reciprocating pump of the first embodiment, respectively illustrating an auxiliary plunger at the start of and after the operation.
Figure 5B:
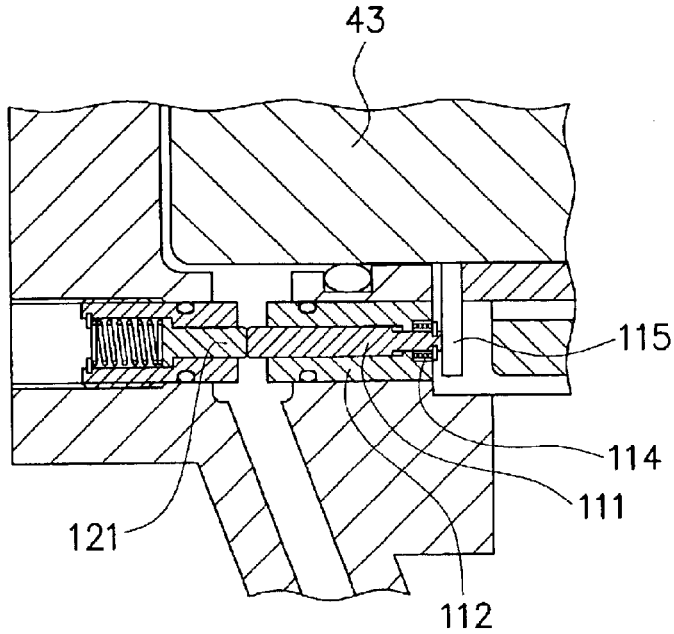

FIGS. 5A and 5B are enlarged views of the auxiliary plunger mechanism subjected to the adjustment and designed to replenish a given amount of operating fluid, in which FIGS. 5A and 5B respectively illustrate the auxiliary plunger at the start and after the operation. Herein, the "given amount" is meant as an amount which enables the reciprocating pump to be operated with maintaining proper pumping efficiency and pulsation state even if operating fluid is discharged along with gas during the gas discharge operation.

In FIGS. 5, the auxiliary plunger mechanism of this embodiment includes operating-fluid pressure means 110 and replenishing-amount adjustment means 120. The operating-fluid pressure means 110 in turn includes auxiliary plunger 111 to be pressed by pressure member 115 attached to the first piston member 43, plunger retaining member 112 by which the auxiliary plunger 111 is slidably retained, spring retaining member 113 secured to the auxiliary plunger 111, and spring member 114 mounted between the plunger retaining member 112 and the spring retaining member 113 so as to urge the auxiliary plunger 111 towards the eccentric cam 42.

The replenishing-amount adjustment means 120 includes adjustment plunger 121 for adjusting the operation time of the auxiliary plunger 111, adjustment-plunger retaining member 122 by which the adjustment plunger 121 is slidably retained, spring retaining member 123 secured to the adjustment-plunger retaining member 122, and spring member 124 mounted between the adjustment plunger 121 and the spring retaining member 123 so as to urge the adjustment plunger 121 towards the operating-fluid pressure means 110 or towards the eccentric cam 42.

The adjustment-plunger retaining member 122 has an outer circumference on which an outwardly threaded portion is formed so as to be threaded with an inwardly threaded portion formed on an inner circumference of adjustment-means insertion member 125. Specifically, in this embodiment, the screw-in depth (screw-in relationship) of the adjustment-plunger retaining member 122 relative to the adjustment-means insertion member 125 is adjusted so that the replenishing-amount adjustment means 120 can be moved in the direction of X (see FIG. 5A). In this embodiment, distance t between an end face of the auxiliary plunger 111 and an end face of the adjustment plunger 121 can be easily adjusted.

In the auxiliary plunger mechanism of this embodiment, a step of replenishing operating fluid is extended before the end face of the auxiliary plunger 111 contacts the end face of the adjustment plunger 121. That is, the distance t between the end face of the auxiliary plunger 111 and the end face of the adjustment plunger 121 regulates the amount of operating fluid to be replenished. As described above, in this embodiment, the distance t (the operation time of the auxiliary plunger 111) can be easily adjusted and therefore the replenishing amount of operating fluid can also be easily adjusted.

As described above, FIG. 5A illustrates the auxiliary plunger 111 at the start of the operation, in which the auxiliary plunger 111 is pressed by the pressure member 115 in response to the motion of the first piston member 43, and slides in the direction of P (see FIG. 5A). As illustrated in FIG. 5B, by the contact of the auxiliary plunger 111 with the adjustment plunger 121, the auxiliary plunger 111 is brought into a state performing no action on operating fluid or applying no pressure or the like to operating fluid. Thus, the state with the plungers 111, 121 contacting to each other represents the time at which the drive of the auxiliary plunger 111 is finished.

That is, in the reciprocating pump of this embodiment, the discharge rate of operating fluid for driving the diaphragm is increased upon determination of the clearance between the plungers 111, 121 so as to replenish the amount of operating fluid discharged along with gas during the gas discharge operation. That is, according to the reciprocating pump of this embodiment, the amount of operating fluid discharged along with gas through the gas discharge mechanism 20 can be replenished by means of the auxiliary plunger mechanism 100. Therefore, the gas discharge operation can be manually or automatically performed in a proper manner without deterioration of the pump efficiency and occurrence of pulsation in the normal operation.

With the above arrangement, when making the amount of operating fluid discharged from the gas discharge mechanism 20 equal to the amount of operating fluid replenished by the auxiliary plunger mechanism 100, the reciprocating pump of this embodiment can secure 100% of the pump efficiency. Also, in the arrangement enabling the automatic gas-discharge operation (having the first lift amount L1 and the second lift amount L2 set at given amounts), air, which may intrude into the operating-fluid-flow regulation chamber 5 during the operation of the reciprocating pump, can be instantly discharged to the outside of the pump without deterioration of the operation efficiency.

With reference to FIGS. 5 and 6, the description was made for the case where the auxiliary plunger mechanism 100 replenishes only the amount of operating fluid discharged from the gas discharge mechanism 20. However, the present invention is not necessarily limited to this arrangement. The amount of fluid to be replenished by the auxiliary plunger mechanism 100 may be adjusted corresponding to increase and decrease of operating fluid in difference portions. For example, in the reciprocating pump, a slight amount of fluid may reversely flow into the inflow-side in a short time before a checking ball rests on the inflow-side valve seat. Also, there may cause deterioration in efficiency of operating fluid due to compression of a slight amount of air remained in operating fluid, variation or decrease in volume of operating fluid itself under ultra-high-pressure. In order to replenish the amount of operating fluid corresponding to the flow rate resulting from the deteriorated efficiency of operating fluid, the auxiliary plunger mechanism may be adjusted.

Figure 6A:
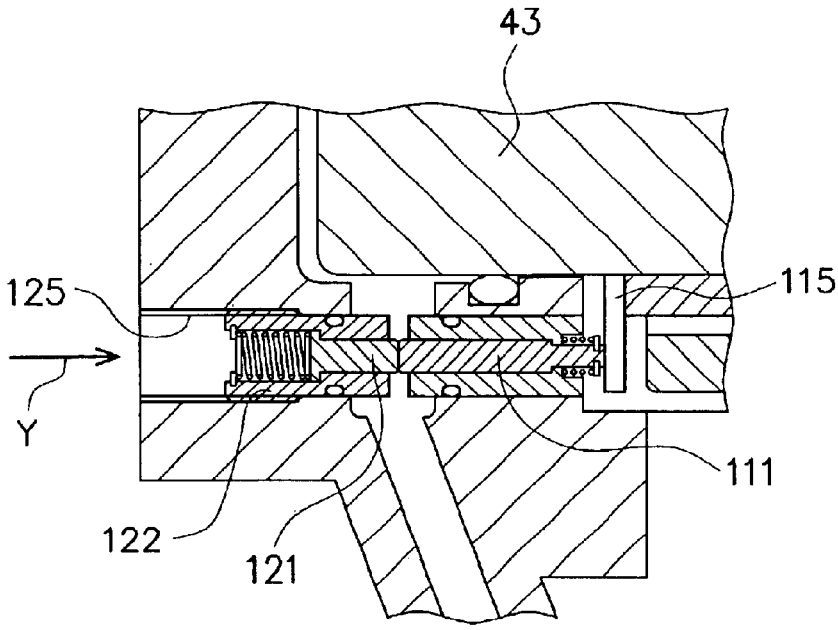
FIGS. 6A and 6B are enlarged views of an auxiliary plunger mechanism as a constitutional element of the reciprocating pump of the first embodiment with the flow rate of the auxiliary plunger set at 0, respectively illustrating the auxiliary plunger at the start of and after the operation.
Figure 6B:
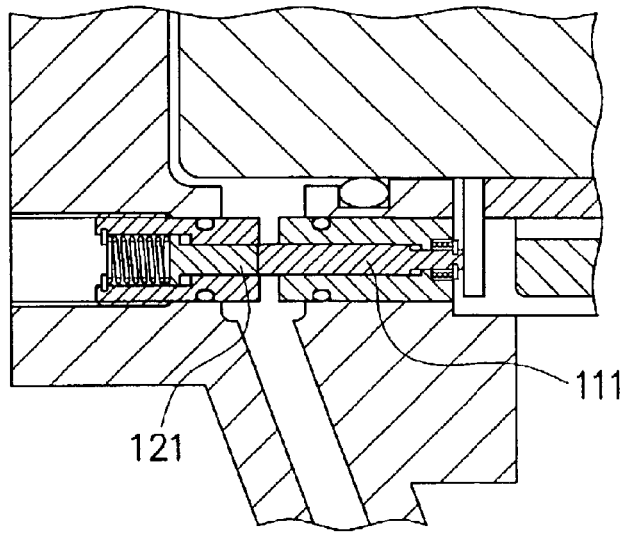

FIGS. 6A and 6B are enlarged views of the auxiliary plunger mechanism with its flow rate set at 0, respectively illustrating the auxiliary plunger at the start of and after the operation The auxiliary plunger 111 and the adjustment plunger 121, which have been adjusted in the manner as illustrated in FIG. 6, are basically driven by the pressure member 115 attached to the first piston member 43 in the same manner as that described with reference to FIG. 5. The difference lies in that the auxiliary plunger 111 and the adjustment plunger 121 are so adjusted as to contact each other even before the pressure member 115 contacts the auxiliary plunger 111 (see FIG. 6A). Specifically, by the adjustment of the screw-in depth or relationship between the adjustment-plunger retaining member 122 and the adjustment-means insertion member 125, the replenishing-amount adjustment means 120 is moved in the direction of Y (see FIG. 6A) from the position as illustrated in FIG. 5A, or the replenishing-amount adjustment means 120 is moved to such a position as to enable the auxiliary plunger 111 to contact the adjustment plunger 121.

Accordingly, the adjustment made in the manner as illustrated in FIG. 6 allows the auxiliary plunger 111 to be held in contact with the adjustment plunger 121 from the start of the operation of the auxiliary plunger 111 (FIG. 6A) to the end of the operation of the same (see FIG. 6B). That is, the adjustment state as illustrated in FIG. 6 causes the distance between the end faces of the auxiliary plunger 111 and the adjustment plunger 121 to be at 0, so that the auxiliary plunger 111 does not perform no action on operating fluid.

As illustrated in FIGS. 5 and 6, the auxiliary plunger mechanism of this embodiment can easily adjust the operation time of the auxiliary plunger 111 when needed. Therefore, in this embodiment, the replenishing-amount adjustment means 120 is properly adjusted according to the pumping performance, pulsation state and the like of each reciprocating pump. As a result, it is possible to provide the reciprocating pump capable of operating with a high pumping efficiency, while effectively preventing pulsation.

Moreover, the reciprocating pump of this embodiment is provided with operating-fluid replenishing valves 150A, 150B near the first and second piston members 43, 44. These operating-fluid replenishing valves 150A, 150B are designed to supply a proper amount of operating fluid to the diaphragm drive chambers 2 when the negative pressure is caused therein, and therefore be capable of varying pressure to be fed. According to this embodiment, the operating-fluid replenishing valves 150A, 150B can start replenishing operating fluid therethrough according to a given pressure even if an excessive pressure is caused due to any problem in each of the diaphragm drive chamber 2, so that the reciprocating pump of this embodiment can maintain a stabilized performance without deterioration of the pump efficiency.

It is to be noted that the present invention is not necessarily limited to this embodiment, but may be subjected to various modifications without departing from the spirit and scope of the present invention. For example, while this embodiment was explained by taking for example the case where a diaphragm is used at a portion contacting a target fluid, the present invention is not necessarily limited to this arrangement. Rather, the reciprocating pump may be made up by using a piston or plunger at a portion contacting the target fluid.

Figure 7:
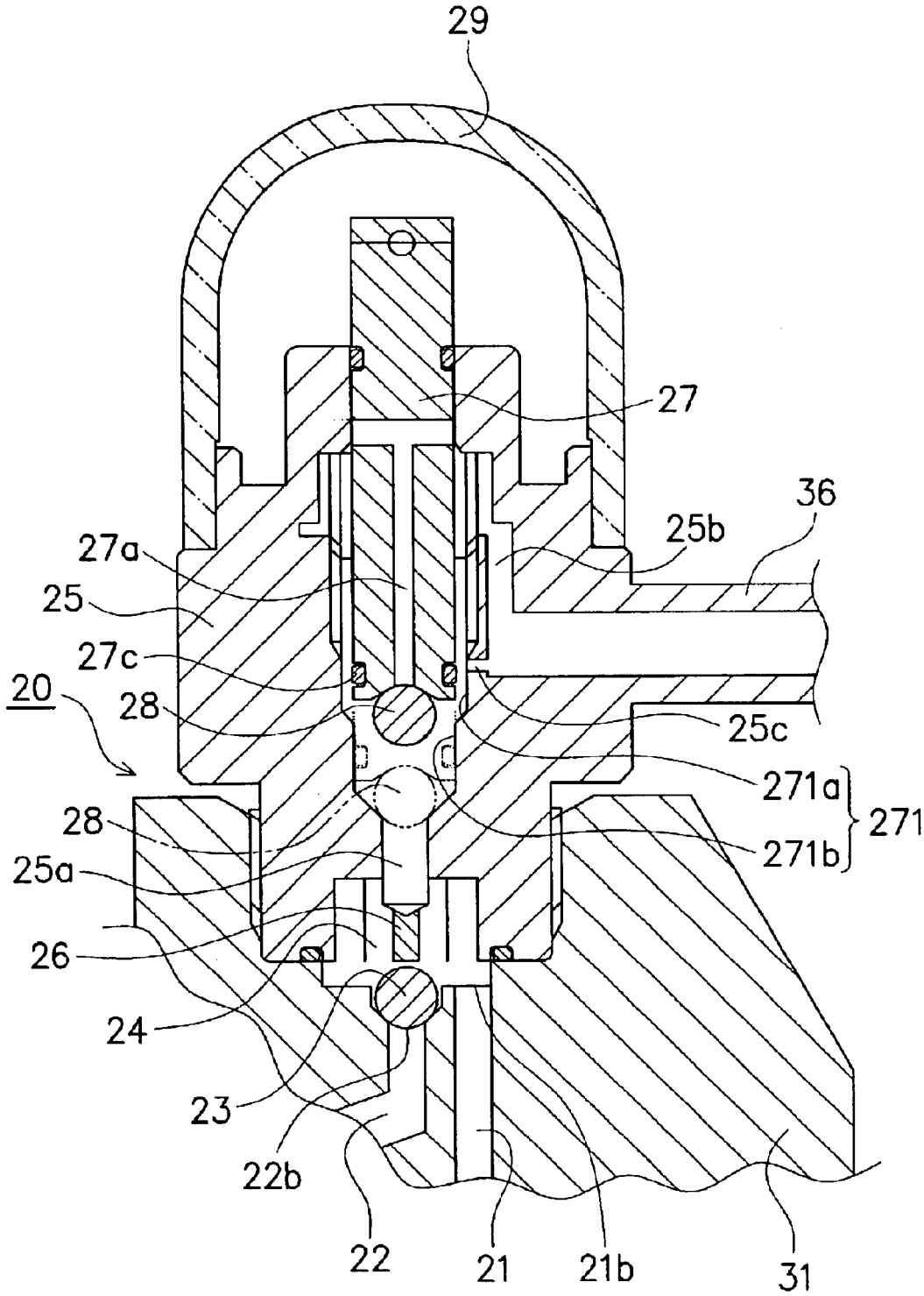
FIG. 7 is an enlarged view of a gas discharge mechanism as a constitutional element of the reciprocating pump according to another embodiment.

FIG. 7 is an enlarged view of the gas discharge mechanism as an constitutional element of the reciprocating pump according to a second embodiment. The reciprocating pump of this embodiment as-illustrated in this Figure basically has the identical structure as that of the first embodiment as illustrated in FIG. 4 and other Figures except for a structure around inwardly threaded portion 271 formed on the fluid-discharge-adjusting member 25 for providing mainly the adjustment valve 27. The reason for employing this structure will be described in comparison with the first embodiment.

For the degasification operation in the gas discharge mechanism as illustrated in FIG. 4 and other Figures at the time of starting-up the reciprocating pump, the pressure of an operating-fluid replenishing valve, which makes up the operating-fluid replenishing mechanism, is set as low as possible, and the pump is driven with the lift amount of the adjustment valve 27 maximized. By driving the pump in this condition, gas within the diaphragm drive chamber 2 and the operating-fluid-flow regulation chamber 5 is compressed by the drive power of the drive-power supply member 40 and discharged through the inside discharge passage 27*a*. Once the pressures within the diaphragm drive chamber 2 and the operating-fluid-flow regulation chamber 5 are lowered after gas has been discharged, operating fluid is replenished thereinto via the operating-fluid replenishing valve. The gas discharging operation and fluid filling operation can be made at the time of starting-up the reciprocating pump upon repeating this operation.

Where volume displacement per one rotation of the reciprocating pump is small because the piston members or the like have relatively smaller diameters, it may take a long time (e.g., ten or more minutes) to discharge the entire amount of gas. Also, the gas discharge mechanism as illustrated in FIG. 4 and other Figures, which is designed to be capable of discharging gas through the inside discharge passage 27*a* only until the second ball member 28 contacts the end of the adjustment valve 27 by the gas pressure, may pose a problem that the inside discharge passage 27*a* is closed and hence gas is not properly discharged, if the second ball member 28 happens to contact the adjustment valve 27 due to any cause. Thus, the gas discharge mechanism as illustrated in FIG. 4 and other Figures may not properly discharge gas in a short time.

In order to address the above problem, the gas discharge mechanism as illustrated in FIG. 7 has the inwardly threaded portion 271 for attaching the adjustment valve 27, which is different in structure from the corresponding portion as illustrated in FIG. 4 and other Figures. That is, in FIG. 7, the inwardly threaded portion 271 has upper part 271*a* and lower part 271*b* respectively formed in different sizes or different inner diameters. Specifically, the lower part 271*b* of the inwardly threaded portion 271 has an inner diameter sized and shaped so as to be sealed by O-ring 27*c*, thereby preventing fluid such as gas from communicating between the adjustment valve 27 and the inwardly threaded portion 271. Also, the upper part 271*a* of the inwardly threaded portion 271 has an inner diameter sized and shaped so as to be capable of releasing the sealing engagement of the O-ring 27*c* when the lift amount of the adjustment valve 27 has been increased.

That is, with the gas discharge mechanism of this embodiment as illustrated in FIG. 7, the adjustment valve 27 can be adjusted so as to communicate fluid such as gas between the adjustment valve 27 and the inwardly threaded portion 271 according to needs. Therefore, even if the inside discharge passage 27*a* has been sealed by the contact of the second ball member 28 with the adjustment valve 27, gas can be properly discharged through a clearance between the adjustment valve 27 and the inwardly threaded portion 271, and discharge bypass passage 25*c*.

Also, with the above arrangement as illustrated in FIG. 7, it is possible to forcibly discharge gas by applying the negative pressure to the gas discharge conduit 36 from the outside where the reciprocating pump has a low pumping performance (gas discharge performance) due to the smaller diameter of the piston members or the like.

Figure 8:
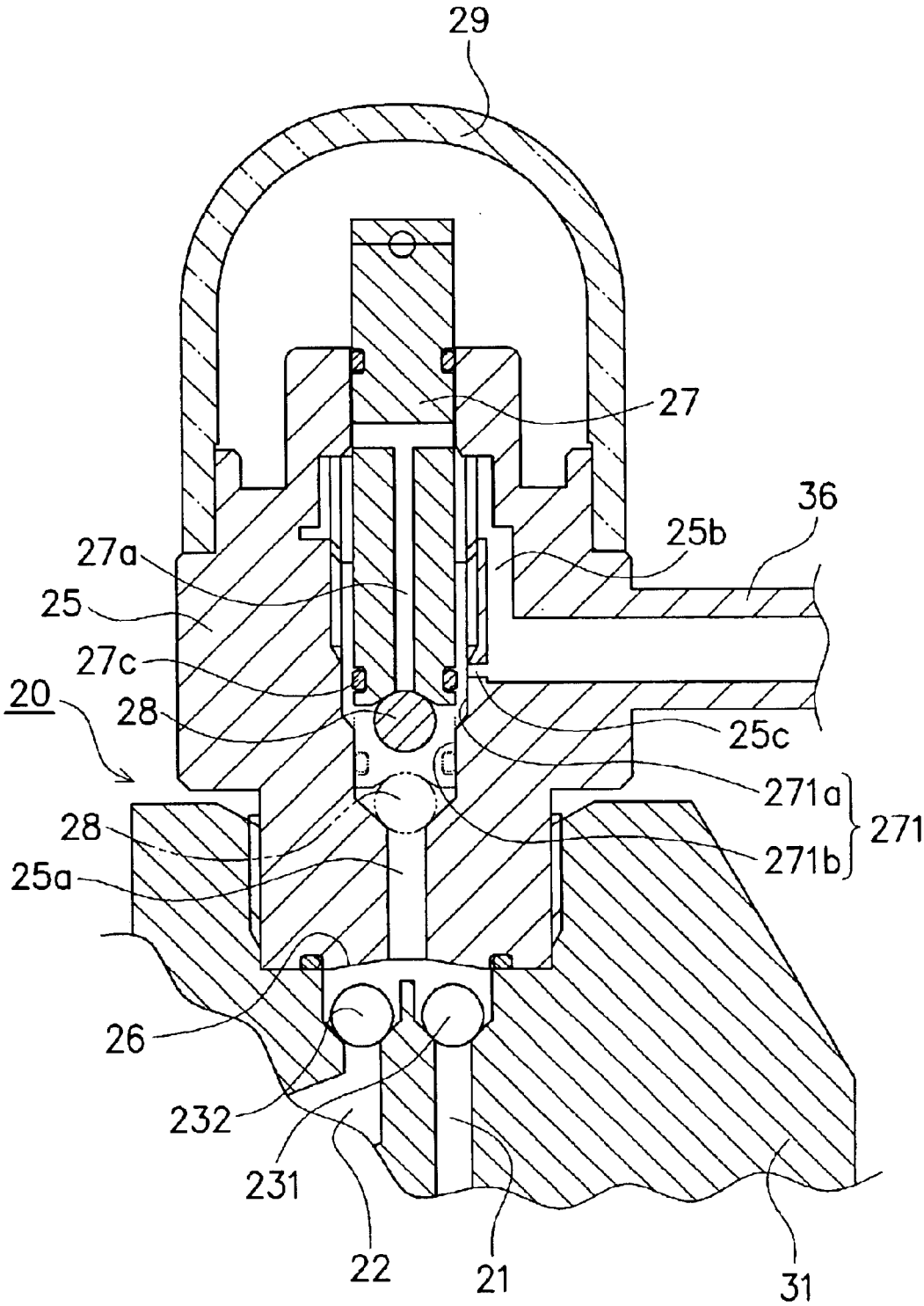
FIG. 8 is an enlarged view of a gas discharge mechanism as a constitutional element of the reciprocating pump according to still another embodiment.

FIG. 8 is an enlarged view of the gas discharge mechanism as a constitutional element of the reciprocating pump according to a different embodiment. The gas discharge mechanism of FIG. 8 has basically the identical structure as that of FIG. 7 except for ball members 231, 232 provided above the first gas-discharge passage 21 and the second gas-discharge passage 22.

With the arrangement as illustrated in FIG. 8, it is not necessary to limit a material of the ball members 231, 232 to that having a specific gravity approximate to that of operating fluid. Accordingly, ceramics or any other materials having a specific gravity greater than that of operating fluid and high sphericity can be used. That is, according to the arrangement with the ball members 231, 232 provided above the gas-discharge passages 21, 22, for example, even if operating fluid has been overflowed through the first gas-discharge passage 21, the ball member 232 blocks a reverse flow, preventing operating fluid from reversely flowing into the second gas-discharge passage 22.

The gas discharge mechanism having the arrangement with the ball members made of polypropylene or the like as described with reference to FIGS. 4 and 7 is preferably applied to constitute a low pressure pump, while the gas discharge mechanism having the arrangement with the ball members as described with reference to FIG. 8 is preferably applied to constitute a high pressure pump. That is, according to the gas discharge mechanism of FIG. 8, which has the ball members 231, 232 made of ceramics or the like having a relatively great specific gravity provided above the first and second gas-discharge passages 21, 22, a reverse flow can be properly prevented even for a high viscous fluid.

Figure 9A:
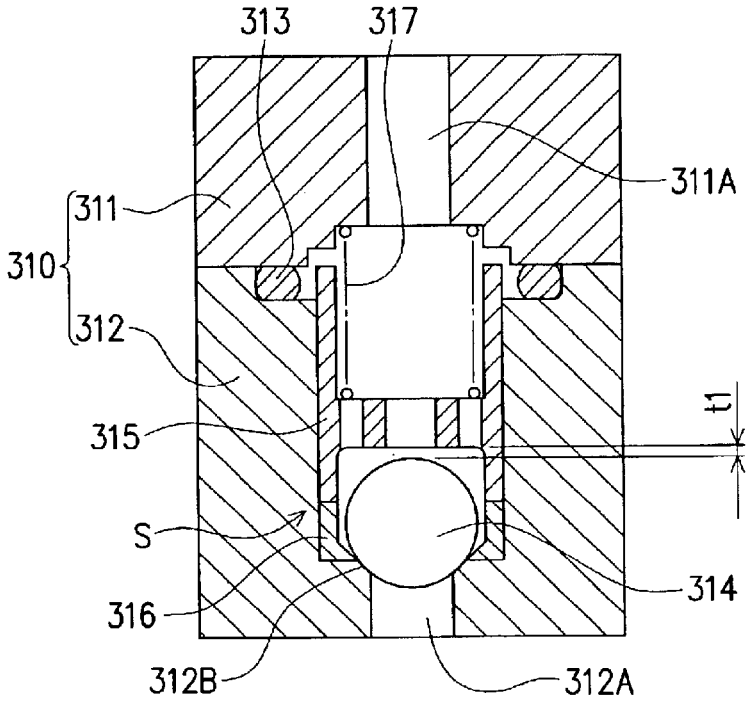
FIGS. 9A and 9B are schematic cross sections illustrating a check valve according to a first embodiment of the present invention.
Figure 9B:
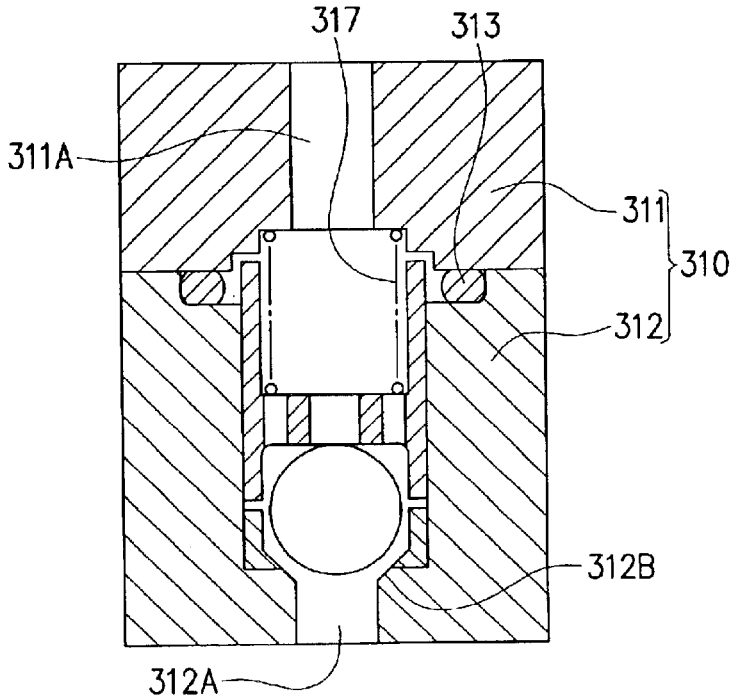

FIGS. 9A and 9B are schematic cross sections illustrating a check valve according to a first embodiment of the present invention. Specifically, FIG. 9A illustrates the check valve with a valve element resting on a valve seat, thereby closing a fluid passage, and FIG. 9B illustrates the same with the valve element released from the valve seat, thereby opening the fluid passage.

As illustrated in FIG. 9, the check valve of this embodiment includes upper body member 311 and lower body member 312 that together make up valve element 310, packing 313 mounted between the upper and lower body members 311, 312, valve element 314, upper guide member 315 and lower guide member 316 for guiding this valve element 314, and urging member 317 such as a spring mounted between the upper body member 311 and the lower guide member 315. The body members 311, 312 as constitutional elements of the check valve respectively form communication passages 311A, 312A for fluid communication.

In this embodiment, the lower guide member 316 is secured to the lower body member 312, while the upper guide member 315 is attached to the upper body member 311 via the urging member 317. When the thus formed check valve lies in a closing state as illustrated in FIG. 9A, the upper guide member 315 contacts the lower guide member 316 (see a portion indicated by "S" in FIG. 9A), thereby creating a given clearance t1 (see FIG. 9A) between the upper guide member 315 and the valve element 314.

When fluid is not supplied to the thus formed check valve, the valve element 314 rests on valve seat 312B of the lower body member 312 so as to close the communication passages 311A, 312A, as illustrated in FIG. 9A. At this moment, as described above, the upper guide member 315 is so designed to have the given clearance t1 relative to the valve element 314, so that the valve element 314 is not pressed against the valve seat 312B.

On the other hand, when fluid is supplied in the check valve from the side of the lower body member 312, the valve element 314 of the check valve is moved away from the valve seat 312B in response to the applied pressure of fluid, as well as lifting up the upper guide member 315 against the urging force of the urging member 317 so as to open the communication passages 311A, 312A of fluid within the check valve.

When fluid supply is stopped with the communication passages 311A, 312A of the check valve in the opened state, the valve element 314 subsequently rests on the valve seat 312B by its own weight and the urging force of the urging member 317. As a result, the communication passages 311A, 312A of the check valve are again closed. That is, the check valve or its communication passages 311A, 312A are repeatedly brought into the closed state and opened state in response to changes in the supplying state or pressure state of fluid.

The check valve of FIG. 9, which functions in the above manner, produces desirable effects as mentioned below.

That is, in the check valve of this embodiment, the valve element 314 is not forcibly pressed against the valve seat 312B by the urging member 317 even during the communication passages 311A, 312A are in the closed state. Rather, the given clearance t1 is created between the upper guide member 315 attached to the urging member 317 and the valve element 314. Therefore, the valve element 314 (spherical valve element) itself is easily rotated by fluid communicated therethrough with the result that the surface of the valve element 314 is evenly worn out. As compared with this, a conventional valve element, which is pressed against a valve seat, may be unevenly worn out.

Also, in this embodiment, the urging member can be set to have a more strengthened urging force than by a conventional member since the given clearance t1 is provided, enabling the valve element 314 to be rotated. Thus, a check valve that exhibits a high response capability in closing operation can be provided. On the contrary, in the conventional arrangement, a given limit must be applied to the urging force of the urging member so as to suppress an uneven wear-out of the valve element, and therefore the urging force of the urging member cannot be strengthened as desired, which leads to deterioration in responsibility in closing operation.

Furthermore, the check valve of this embodiment can achieve constant fluid delivery even for a high viscous fluid, thanks to a high response capability in closing operation.

Figure 10A:
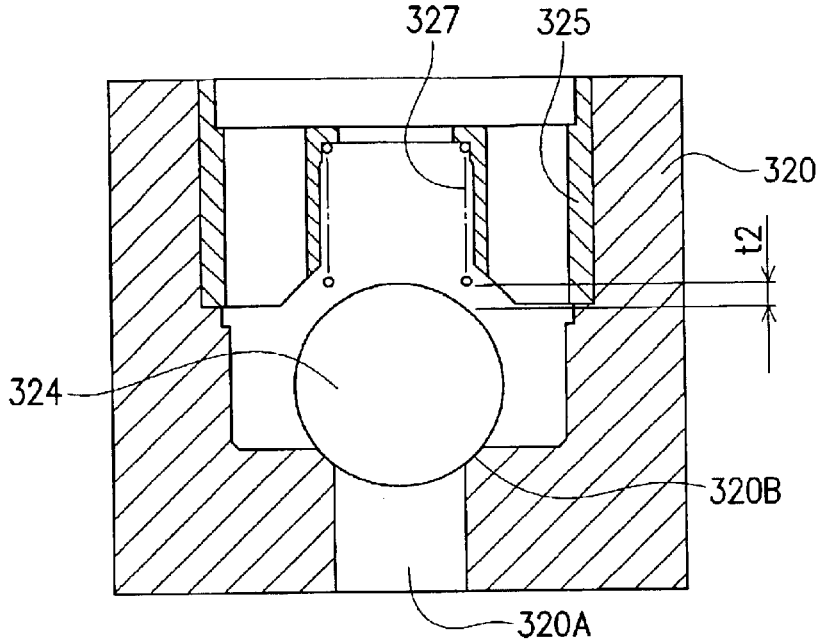
FIGS. 10A and 10B are schematic cross sections illustrating the check valve according to a second embodiment of the present invention.
Figure 10B:
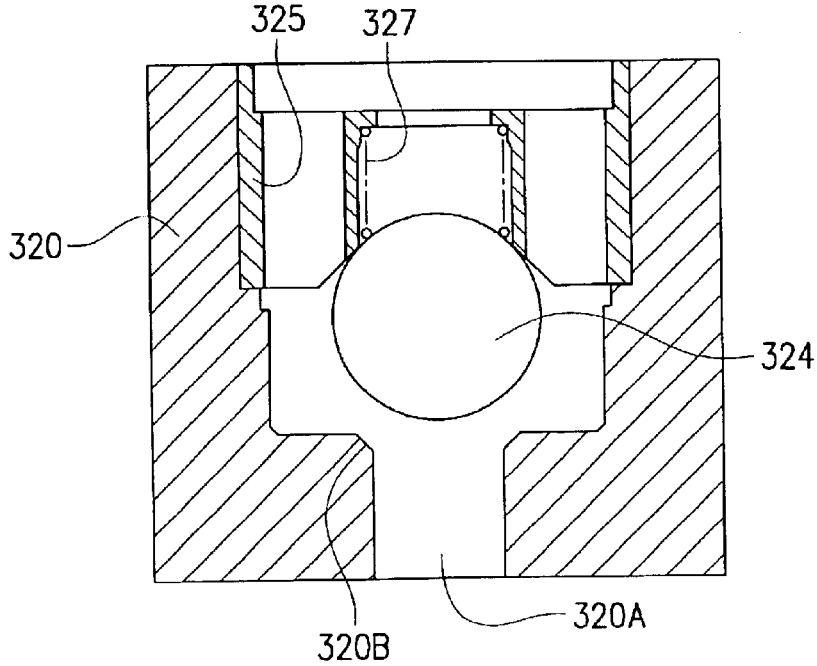

FIGS. 10A and 10B are schematic cross sections illustrating the check valve according to a second embodiment of the present invention. Specifically, FIG. 10A illustrates the check valve with a valve element resting on a valve seat, thereby closing a fluid passage, and FIG. 10B illustrates the same with the valve element released from the valve seat, thereby opening the fluid passage.

As illustrated in FIGS. 10, the check valve of this embodiment includes valve body 320, valve element 324, upper guide member 325 for guiding this valve element 324, and urging member 327 such as a spring mounted to the upper guide member 325. The valve body 320 of the check valve forms communication passage 320A for fluid communication.

In this embodiment, the urging member 327 is mounted to the upper guide member 325 and is designed to have a given clearance t2 relative to the valve element 324 (see FIG. 10A) during the check valve lies in the closed state (see FIG. 10A).

In a similar manner as the check valve of FIG. 9, when no fluid is supplied through the check valve as illustrated in FIGS. 10, the valve element 324 rests on valve seat 320B so as to close the communication passage 320A, and the valve element 324 is not pressed against the valve seat 320B by the urging member 327, since it has the given clearance relative to the valve element 324.

On the other hand, when fluid is supplied through the check valve, the valve element 324 of the check valve is moved away from the valve seat 320B as illustrated in FIG. 10B, in response to the applied pressure of fluid, as well as bending the urging member 327 upward against the urging force of the urging member 327 so as to open the communication passage 320A within the check valve.

When fluid supply is stopped with the communication passage 320A of the check valve in the opened state, the valve element 324 subsequently rests on the valve seat 320B by its own weight and the urging force of the urging member 327. As a result, the communication passage 320A of the check valve is again closed. That is, the check valve is repeatedly brought into the closed state and opened state in response to changes in the supplying state or pressure state of fluid.

The check valve as illustrated in FIG. 10 is designed to make the urging member 327 contact the valve element 324, while the given clearance t2 is provided between the valve element 324 and the valve seat 320B during the valve element 324 rests on the valve seat 320B in the same manner as the aforesaid check valve (see FIG. 9). Therefore, the check valve of FIG. 10 also produces the same desirable effects.

In FIG. 10, any guide member for the valve element 324 is not provided near the valve seat 320B of the valve body 320. However, the present invention is not necessarily limited to this arrangement, and therefore a guide member may be provided near the valve seat 320B according to needs.

Figure 11:
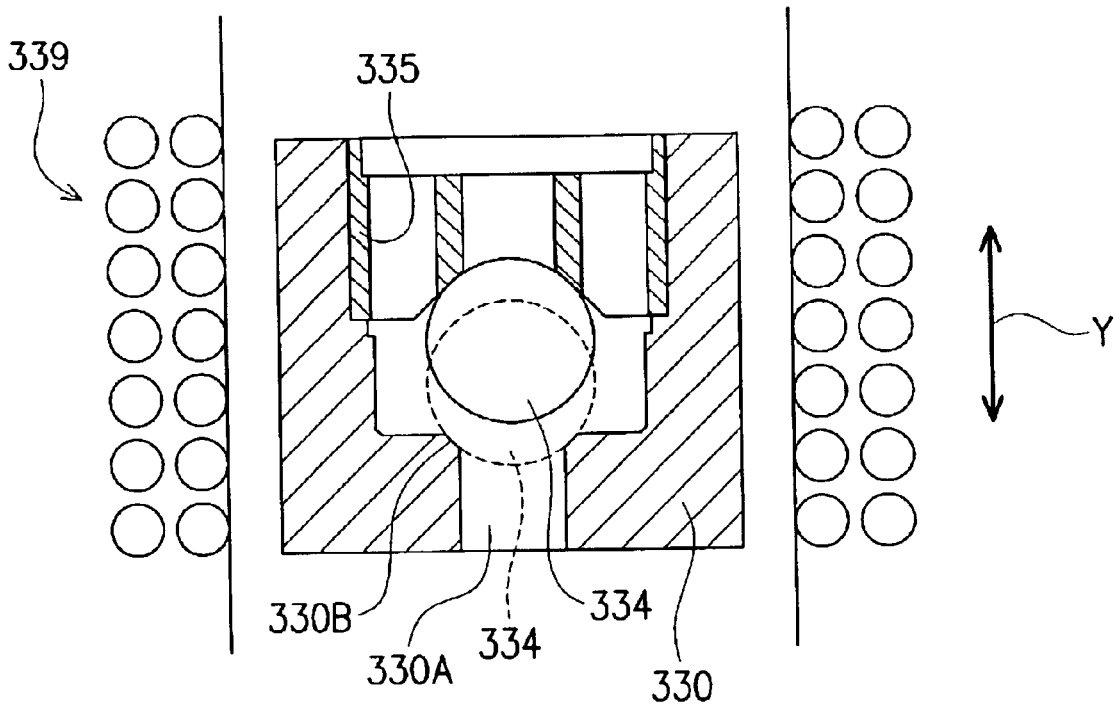
FIG. 11 is a schematic cross section illustrating the check valve according to a third embodiment of the present invention.

FIG. 11 is a schematic cross section illustrating the check valve according to a third embodiment of the present invention, in which valve element 334 in broken line is illustrated as being in such a position as to close communication passage 330A by resting on valve seat 330B, and the valve element 334 in solid line is illustrated as being in such a position as to open the communication passage 330A by moving away from the valve seat 330B.

As illustrated in FIG. 11, the check valve of this embodiment includes valve body 330, the valve element 334, upper guide member 335 for guiding this valve element 334, and coil member 339 mounted outside of the valve body 330. The valve body 330 of the check valve forms the communication passage 330A.

In the check valve thus formed as illustrated in FIG. 11, electromagnetic force, which acts on the valve element 334, is generated by electric power supplied to the coil member 339, so that the valve element 334 can be forcibly moved (in the vertical direction in this embodiment as indicated by the arrow Y in FIG. 11) by properly switching the polarity of the supplied electric power.

That is, the check valve of this embodiment is made of a material which can be magnetized or attracted by a magnetic force so that an electromagnetic force of the coil member 339 mounted outside of the valve body 330 acts on the valve element 334. Therefore, by properly controlling or reversing the polarity of the electric current supplied to the coil member 339, it is possible to achieve the check valve that exhibits a high response capability in operation according to this embodiment. If a need arises, a capacitor is provided in an electric power supply line for the coil member 339 (an electromagnet) so as to shorten the time for supplying electric current. As a result, it is possible to provide the check valve that exhibits a higher response capability.

That is, according to the check valve of this embodiment, the valve element 334 can be forced to be moved in the vertical direction without using an urging member such as a spring, and is not pressed against the valve seat 330B by supplying no electricity to the coil member 339 during seating. Therefore, in the same manner as that of the check valve of FIGS. 9 and 10, the check valve of FIG. 11 can achieve a constant delivery of fluid in an efficient manner even if it has a high viscosity, while preventing an uneven wear-out of the valve element 334.

Figure 12:
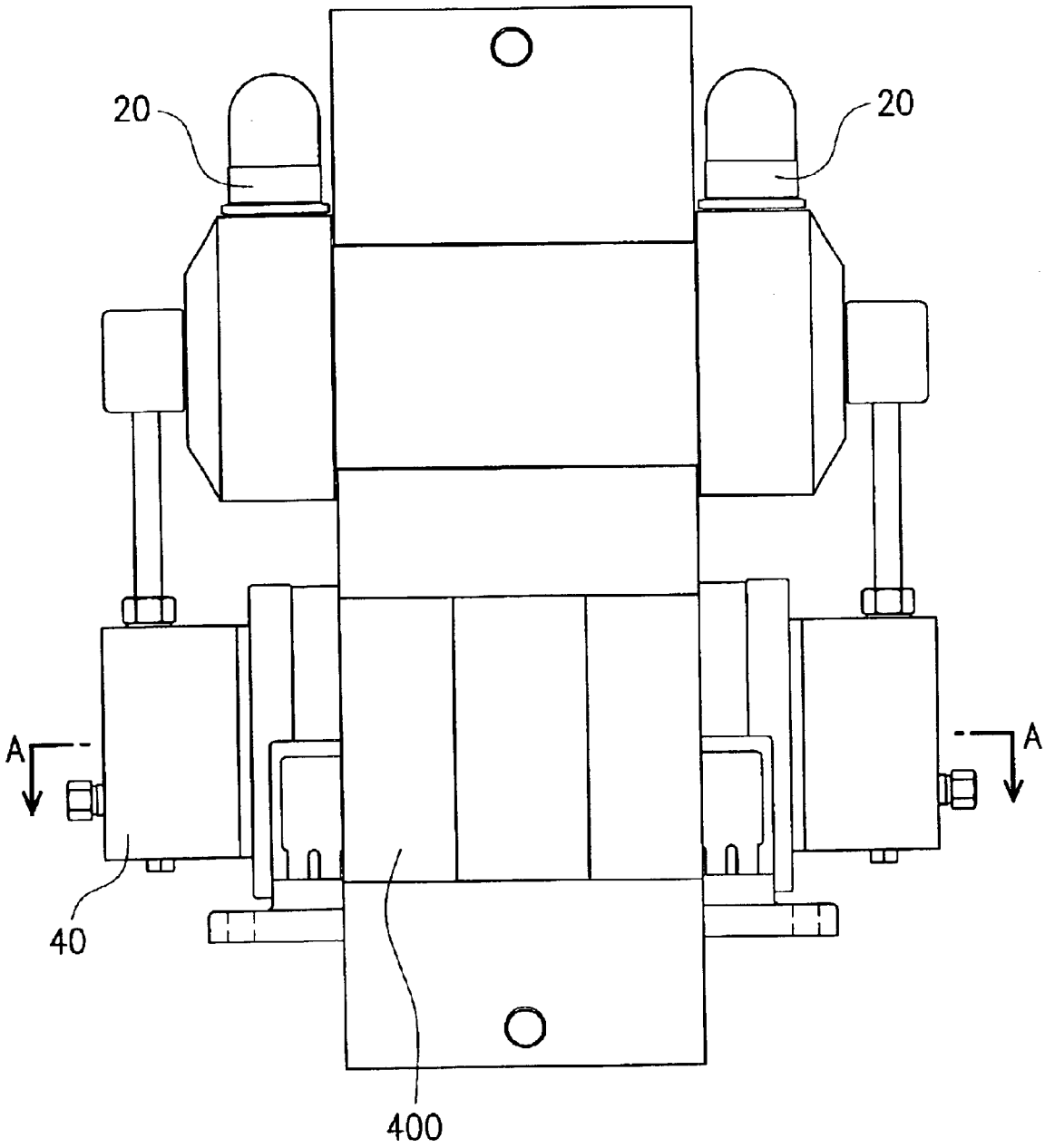
FIG. 12 is an outline view illustrating a front side of the reciprocating pump according to a third embodiment of the present invention.
Figure 13:
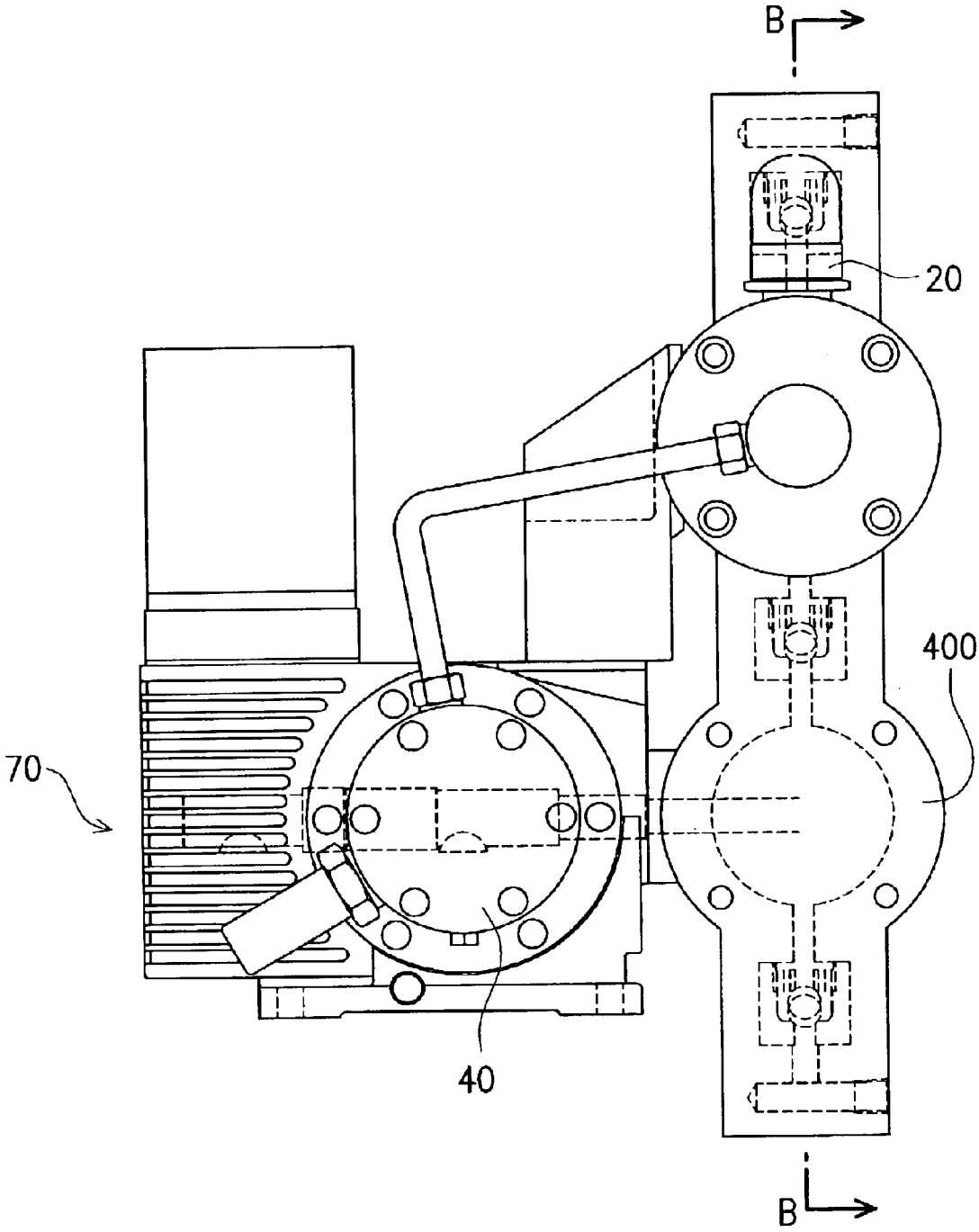
FIG. 13 is an outline view illustrating a lateral side of the reciprocating pump of FIG. 12.
Figure 14:
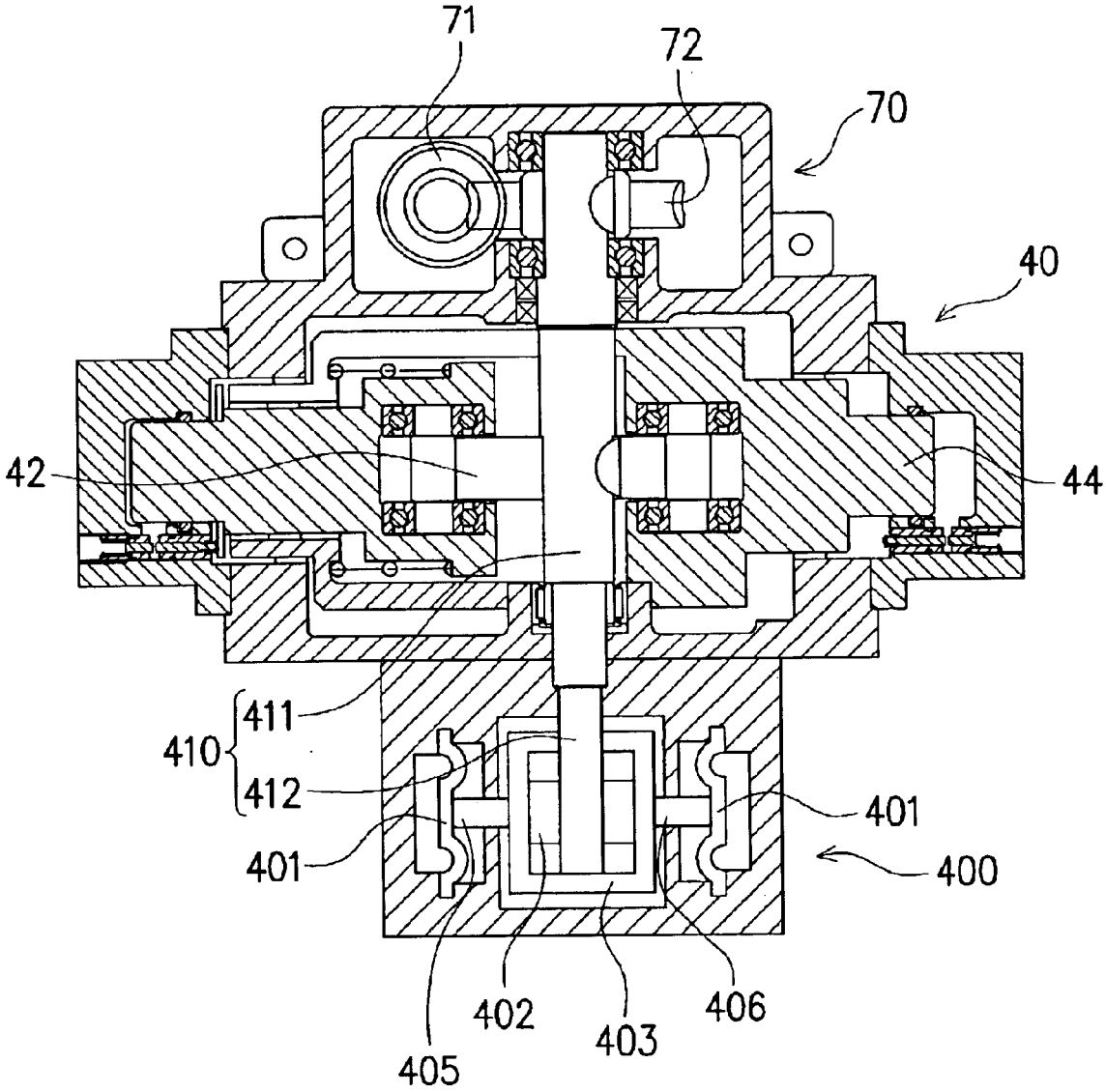
FIG. 14 is a schematic cross section taken along a line A—A in FIG. 12.

It is to be noted that the reciprocating pump of the present invention is not necessarily limited to the embodiments as illustrated in FIGS. 1 to 7, and therefore can employ the arrangements as illustrated in FIGS. 12 to 14, when needed. In the following description, the basic structure is the same as that illustrated with reference to FIGS. 1 to 7, so that corresponding or identical parts to those of the embodiments have been given the same reference characters to omit a detailed description thereof.

Figure 15:
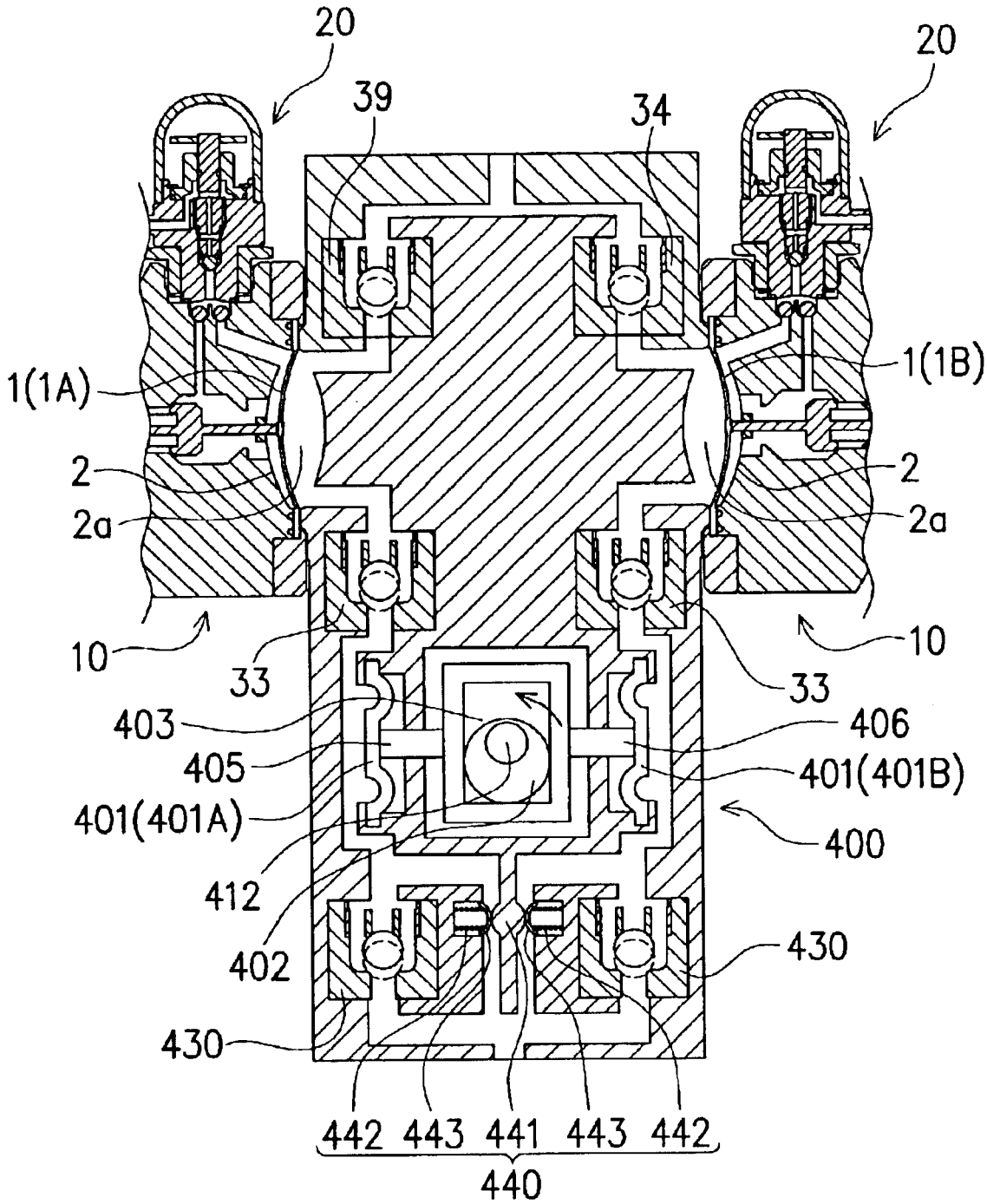
FIG. 15 is a schematic cross section taken along a line B—B in FIG. 13.

FIG. 12 is an outline view illustrating a front side of the reciprocating pump according to a third embodiment of the present invention. FIG. 13 is an outline view illustrating a lateral side of the reciprocating pump of FIG. 12. FIG. 14 is a schematic cross section taken along a line A—A in FIG. 12. FIG. 15 is a schematic cross section taken along a line B—B in FIG. 13.

The reciprocating pump as illustrated in FIGS. 12 to 15 has the identical structure as that of the reciprocating pump as described above except for an auxiliary drive member provided so as to deliver fluid into a fluid delivery chamber within the diaphragm drive chamber. Therefore, the following description will be made mainly for the auxiliary drive member.

As illustrated in FIGS. 14 and 15, the reciprocating pump of this embodiment includes fluid delivery path 10 for delivering fluid by reciprocating the diaphragm 1, drive-power supply member 40 for supplying operating fluid at a proper timing so as to drive the diaphragm 1, drive member 70 for driving the eccentric cam 42 of the drive-power supply member 40, and auxiliary drive member 400 for delivering fluid to fluid delivery section 2*a* of the fluid delivery path 10.

In this embodiment, the drive member 70 includes electric motor 71 for generating rotational motion, and gear member 72 for transmitting rotational power from this electric motor 71 to drive-power transmission shaft 410. This drive-power transmission shaft 410 is designed to supply rotational power to the eccentric cam 42, which constitutes the drive-power supply member 40, and auxiliary eccentric cam 402, which constitutes the auxiliary drive member 400. Specifically, the drive-power transmission shaft 410 of this embodiment is constituted by the integral-arrangement of first shaft member 411 for rotating the eccentric cam 42 and second shaft member 412 for rotating the auxiliary eccentric cam 402.

The auxiliary drive member 400 includes the auxiliary eccentric cam 402 mounted on the second shaft member 412, which is drivingly rotated in the manner as described above, and auxiliary diaphragms 401 (corresponding to a first auxiliary diaphragm and a second auxiliary diaphragm of the present invention) for being driven in response to the motion of the auxiliary eccentric cam 402. More specifically, the auxiliary drive member 400 includes auxiliary movable member 403 that is held in contact with the auxiliary eccentric cam 402 so as to reciprocate the auxiliary eccentric cam 402 in a lateral direction in response to the rotation of the auxiliary eccentric cam 402, and movable shaft means (a first movable shaft 405 and a second movable shaft 406) mounted on the auxiliary movable member 403 so as to reciprocate the diaphragms 1 in response to the motion of the auxiliary movable member 403.

On the upstream side of the diaphragms 1 are respectively provided inflow-side auxiliary check valves 430, which are opened and closed based upon the reciprocating state of the diaphragms 1. In this embodiment, in order to prevent an excessive amount (pressure) of fluid from being delivered to the fluid delivery chamber, auxiliary leak members 440 are provided, which are disposed on the downstream sides of the check valves 430 and each include leak support member 441, closing member 443 disposed closer to this leak support member 441 for opening and closing a fluid passage, and urging member 442 such as a spring for urging the closing member 443 into contact with the leak support member 441.

The thus formed reciprocating member of this embodiment will be operated in the following manner.

That is, in each of the fluid delivery paths of the reciprocating pump as illustrated in FIGS. 12 to 15, fluid is delivered into the fluid delivery section 2*a* not only by the diaphragm 1, but also the auxiliary drive member 400. More specifically, for example, the diaphragm 1 and the auxiliary diaphragm means 401, which are placed in the same fluid delivery path or placed such as in the left hand side in FIG. 15, are so operated that when one of them proceeds with a discharging step, another proceeds with a suction step.

Figure 16:
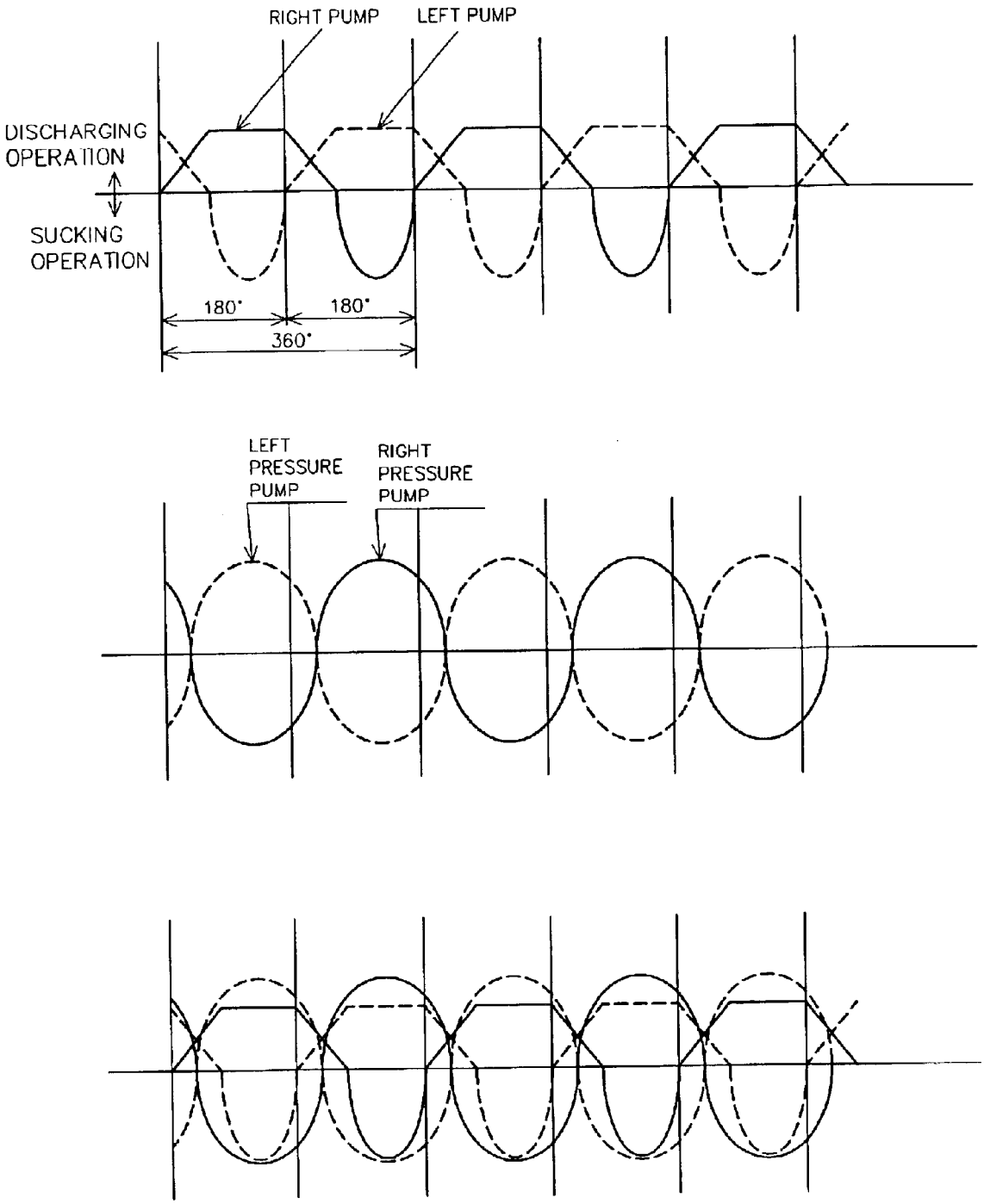
FIGS. 16 illustrate pressure wave profiles of diaphragms illustrated in FIG. 12 and other Figures, in which FIGS. 16A, 16B and 16C respectively illustrate a pressure wave profile of the diaphragm, a pressure wave profile of an auxiliary diaphragm and those profiles overlapped with each other.

FIG. 16 illustrate pressure wave profiles of the diaphragm 1 and the auxiliary diaphragm 401, in which FIGS. 16A, 16B and 16C respectively illustrate a pressure wave profile of the diaphragm 1, a pressure wave profile of the auxiliary diaphragm 401 and those profiles overlapped with each other.

In FIG. 16, wave profiles in broken line and solid line respectively represent those for the diaphragm 1 and the auxiliary diaphragm 401 in the same fluid delivery path. For example, the solid line represents the diaphragm 1B (a right pump) and the auxiliary diaphragm 401B (a right pressure pump) located in the right hand side in FIG. 15, while the broke line represents the diaphragm 1A (a left pump) and the auxiliary diaphragm 401A (a left pressure pump) located in the left hand side in FIG. 15.

As described above, in this embodiment, the discharging and sucking operations of the diaphragm 1 and the auxiliary diaphragm means 401 are alternately and repeatedly performed so that when the diaphragm 1 proceeds with the sucking operation, the auxiliary diaphragm means 401 proceeds with the auxiliary diaphragm means 401. As a result, a necessary amount of fluid is properly delivered to the fluid delivery section 2*a*.

When a high viscous fluid or the like is to be delivered, a pump with only the diaphragm 1 driven may not be able to suck a necessary amount of fluid and deliver the same to the fluid delivery section 2*a* due to a high viscosity of the fluid, and hence may not achieve a constant delivery. However, in this embodiment, even if poor suction of fluid occurs due to driving of only the diaphragm 1, the amount of fluid to be replenished to the fluid delivery section 2*a* can be delivered by driving the auxiliary drive member 400, thus achieving a constant delivery of fluid in a proper manner.

In this embodiment, the auxiliary drive member 400 designed to properly replenish fluid is driven by the drive member 70 as a driving source, which also drives the drive-power supply member 40. That is, according to this embodiment, the auxiliary drive member 400 can be employed with omitting the necessity to use an additional driving source.

Moreover, in this embodiment, the auxiliary leak member 440 is actuated when the pressure on the downstream side of the check valve 430 has increased to a value greater than a given pressure (e.g., 0.45 MPa), so as to remove the closing member 443 from the leak support member 441. That is, an adjustment is made to the urging force of the urging member 442 so as to allow leakage of fluid when the pressure within the fluid passage has been increased to a value higher than a given pressure.

The above arrangement omits the possibility of increasing the pressure within the fluid delivery section 2*a* to an unnecessarily high value, and therefore prevents damages of the diaphragm 1 and the auxiliary diaphragm 401. A given pressure of the auxiliary leak member 440 is determined according to the constant rate of fluid, which the diaphragm 1 delivers. That is, in the present invention, consideration has bee made to avoid excessive supply of fluid, it is possible to achieve fluid delivery at a precisely controlled constant rate by providing the auxiliary leak member 440.

It is a matter of course that the present invention is not limited to this embodiment, and may be subjected to various modification without departing from the spirit and scope of the present invention.

Figure 17:
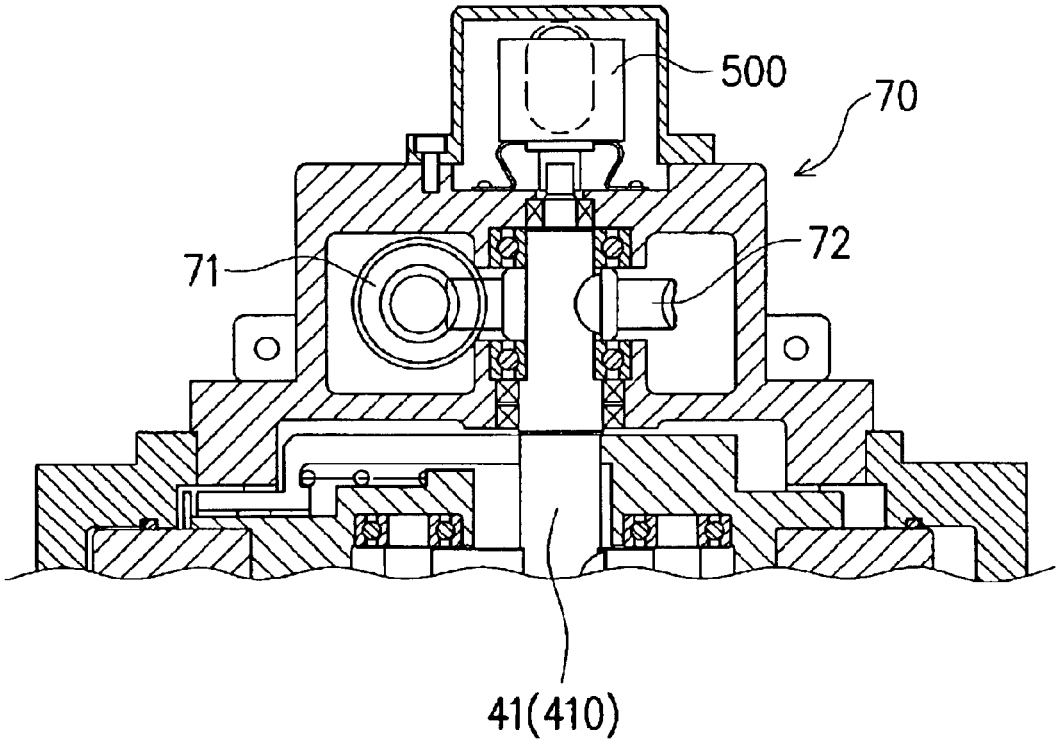
FIG. 17 is a partial cross section of the reciprocating pump according to another embodiment of the present invention.

For example, the reciprocating pump as illustrated in FIGS. 1–7 and that as illustrated in FIGS. 12–15 each are provided with plural check valves 33, 34, 430, each of which is designed to have the valve element (ball member) to be moved away from the valve seat to open the communication passage and to rest on the valve seat by its own weight along with decrease in fluid pressure, thereby closing the communication passage. The present invention is not necessarily limited to this structure. For example, the reciprocating pump may be made up by using the check valves as illustrated in FIGS. 9–11 according to needs. These check valves each are forcibly moved to the valve seat at the start of closing the communication passage, so that they can exhibit a high response capability in closing operation. As a result, it is possible to provide the reciprocating pump that has desirable effects produced by the check valve of this kind, and more specifically the reciprocating pump that is capable of delivering fluid at a precisely controlled constant rate, and the reciprocating pump that can be used for a prolonged period of time by the prevention of uneven wear-out of the valve element.

Where the reciprocating pump is made up by using the coil member 339 or utilizing the electromagnetic force, as illustrated in FIG. 11, it is preferable to utilize encoder 500 as illustrated in FIG. 17. Specifically, by using this encoder 500, it is possible to detect the timing at which the valve element 334 rests on the valve seat within the check valve or any other timing, and control the timing at which an electric power is supplied to the coil member 339, the timing at which the polarity is reversed or any other timing based upon the detected result. In this regard, the timing at which the valve element rests on the valve seat can be observed by, for example, detecting the rotational numbers of the drive-power transmission shafts 41, 419.

Thus, it is possible to provide the reciprocating pump equipped with the gas discharge mechanism that is capable of properly and automatically discharging gas without involving a troublesome work. Also, according to the present invention, it is possible to provide the check valve that is capable of reducing local or uneven wear-out of the ball member and the valve seat without priming fluid thereinto. Also, it is possible to provide the reciprocating pump that is capable of delivering fluid at a constant rate even if fluid has a high viscosity.

This specification is by no means intended to restrict the present invention to the preferred embodiments set forth therein. Various modifications to the reciprocating pump and the check valve as described herein, may be made by those skilled in the art without departing from the spirit and scope of the present invention as defined in the appended claims.

What is claimed is:

1. A reciprocating pump for delivering fluid comprising:

a diaphragm that is reciprocated so as to deliver fluid;

a diaphragm drive chamber provided therein with said diaphragm;

a drive-power supply member for supplying drive power for reciprocating said diaphragm; wherein drive power of said drive-power supply member is transmitted to said diaphragm within said diaphragm chamber via operating fluid and an operating-fluid-flow regulation chamber for regulating the flow of operating fluid is located between said drive-power supply member and said diaphragm drive chamber;

a first gas discharge member and a second gas discharge member are respectively located in an upper part of the inside of said operating-fluid-flow regulation chamber and an upper part of the inside of said diaphragm drive chamber;

said first gas discharge member is held in fluid communication with said second gas discharge member so as to constitute a single gas discharge mechanism, said single gas discharge mechanism being provided with a reverse-flow prevention member for preventing a reverse flow of fluid from said first gas discharge member to said second gas discharge member;

said single gas discharge mechanism is made up by using said first gas discharge member, said second gas discharge member, said reverse-flow prevention member and a fluid-discharge adjusting member; and said fluid-discharge-adjusting member is made up by using a ball member provided above said reverse-flow prevention member, and an adjustment valve for adjusting a lift amount of said ball member.

2. A reciprocating pump according to claim 1, wherein the lift amount of said reverse-flow prevention member and the lift amount of said ball member are set at given amounts so that gas is automatically discharged from said first gas discharge member and said second gas discharge member.

3. A reciprocating pump according to claim 2, wherein said lift amount of said reverse-flow prevention member is set at about 0.5 mm–2.0 mm, and said lift amount of said ball member is set at about 0.5 mm–2.0 mm.

4. A reciprocating pump according to claim 2, wherein said reverse-flow prevention member is a ball member, which is made of a material having a specific gravity being approximate to a specific gravity of operating fluid.

5. A reciprocating pump for delivering fluid comprising:

a diaphragm that is reciprocated so as to deliver fluid;

a diaphragm drive chamber provided therein with said diaphragm;

a drive-power supply member for supplying drive power for reciprocating said diaphragm; wherein drive power of said drive-power supply member is transmitted to said diaphragm within said diaphragm drive chamber via operating fluid, and an operating-fluid-flow regulation chamber for regulating the flow of operating fluid is located between said drive-power supply member and said diaphragm drive chamber;

said operating-fluid-flow regulation chamber is provided with a valve element that is provided adjacent to said diaphragm to be driven along with said diaphragm, and a valve seat that is brought into engagement with said valve element so as to regulate operating fluid supplied into said diaphragm drive chamber;

a first gas discharge passage and a second gas discharge passage are respectively located above said operating-fluid-flow regulation chamber and above said diaphragm drive chamber;

said first gas discharge passage is held in fluid communication with said second gas discharge passage so as to constitute a single gas discharge mechanism, said first gas discharge passage having a first end in fluid communication with said operating-fluid-flow regulation chamber via an upper part of the inside thereof between said drive-power supply member and said valve seat;

said second gas discharge passage having a first end in fluid communication with said diaphragm drive chamber via an upper part of the inside thereof between said valve seat and said diaphragm; and said single gas discharge mechanism is provided with a first ball member that rests on a second end of said first gas discharge passage so as to prevent operating fluid from reversely flowing from said second gas discharge passage into said first gas discharge passage, and a second ball member that rests on a second end of said second gas discharge passage so as to prevent operating fluid from reversely flowing from said first gas discharge passage into said second gas discharge passage.

6. A reciprocating pump according to claim 5, wherein:

said second ends of said first gas discharge passage and said second gas discharge passage are located close to each other; said first ball member is provided on said second end of said first gas discharge passage so that when fluid is discharged from said second gas discharge passage, said first ball member is pressed against said second end of said first gas discharge passage, and when fluid is discharged from said first gas discharge passage, said first ball member is lifted up from said second end of said first gas discharge passage; and said second ball member is provided on said second end of said second gas discharge passage so that when fluid is discharged from said first gas discharge passage, said second ball member is pressed against said second end of said second discharge passage upon receiving the pressure of said fluid so as to close said second end of said second gas discharge passage, and when fluid is discharged from said second gas discharge member passage, said second ball member is lifted up from said second end of said second gas discharge passage so as to open said second end of said second gas discharge passage.

7. A reciprocating pump according to claim 5, wherein an operating-fluid replenishing means is provided so as to replenish the amount of operating fluid discharged from at least one of said first gas discharge member and said second gas discharge member.

* * * * *